US010890184B2

(12) United States Patent
Iwatake et al.

(10) Patent No.: US 10,890,184 B2
(45) Date of Patent: Jan. 12, 2021

(54) SCROLL COMPRESSOR AND REFRIGERATION CYCLE APPARATUS INCLUDING INJECTION PORT OPENING INTO SUCTION CHAMBER

(71) Applicant: Mitsubishi Electric Corporation, Chiyoda-ku (JP)

(72) Inventors: Wataru Iwatake, Chiyoda-ku (JP); Raito Kawamura, Chiyoda-ku (JP); Shin Sekiya, Chiyoda-ku (JP); Kei Sasaki, Chiyoda-ku (JP); Shinichi Wakamoto, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 276 days.

(21) Appl. No.: 15/779,589

(22) PCT Filed: Jan. 22, 2016

(86) PCT No.: PCT/JP2016/051865
§ 371 (c)(1),
(2) Date: May 29, 2018

(87) PCT Pub. No.: WO2017/126106
PCT Pub. Date: Jul. 27, 2017

(65) Prior Publication Data

US 2020/0271115 A1 Aug. 27, 2020

(51) Int. Cl.
*F04C 18/02* (2006.01)
*F04C 29/00* (2006.01)
(Continued)

(52) U.S. Cl.
CPC ..... *F04C 18/0261* (2013.01); *F04C 18/0215* (2013.01); *F04C 29/0007* (2013.01); *F04C 29/042* (2013.01); *F04C 29/12* (2013.01)

(58) Field of Classification Search
CPC ..... F04C 18/0215; F04C 29/0007; F04C 29/042; F04C 29/026; F04C 29/021
See application file for complete search history.

(56) References Cited

U.S. PATENT DOCUMENTS 4,216,661 A 8/1980 Tojo et al.
4,475,360 A * 10/1984 Suefuji ..... F04C 18/0215 62/324.1

(Continued)

FOREIGN PATENT DOCUMENTS

EP 2 857 686 A1 4/2015
JP 60-186778 A 8/1985

(Continued)

OTHER PUBLICATIONS

Extended European Search Report dated Dec. 13, 2018 in European Patent Application No. 16886347.0, 12 pages.

(Continued)

*Primary Examiner* — Mary Davis
(74) *Attorney, Agent, or Firm* — Xsensus LLP

(57) ABSTRACT

An object is to obtain a scroll compressor that can reduce an outflow of injection refrigerant into an oil sump, reduce degradation of reliability associated with a decrease in viscosity of refrigerating machine oil stored in the oil sump, and reduce degradation of performance caused by compression of dead volume, and thereby achieve high efficiency, and to also obtain a refrigeration cycle apparatus. An injection port opens only to a suction chamber and is provided in a baseplate of a fixed scroll. In all phases of rotation of a rotation shaft, the injection port is located on an inner side of an outer edge of a structure unit that is configured by meshing a spiral body of the fixed scroll and a spiral body of an orbiting scroll with each other.

9 Claims, 17 Drawing Sheets

(51) Int. Cl.
*F04C 29/12* (2006.01)
*F04C 29/04* (2006.01)

(56) References Cited

U.S. PATENT DOCUMENTS

| | | | | | |
|---|---|---|---|---|---|
| 4,676,075 | A * | 6/1987 | Shiibayashi | F04C 18/0215 | 62/469 |
| 5,076,067 | A | 12/1991 | Prenger et al. | | |
| 6,053,715 | A * | 4/2000 | Hirano | F04C 29/0014 | 418/181 |
| 2008/0184733 | A1 * | 8/2008 | Skinner | F04C 18/0215 | 62/505 |
| 2010/0300659 | A1 | 12/2010 | Stover et al. | | |
| 2014/0037486 | A1 | 2/2014 | Stover et al. | | |
| 2015/0098852 | A1 | 4/2015 | Kim et al. | | |

FOREIGN PATENT DOCUMENTS

| | | | |
|---|---|---|---|
| JP | 2553044 | Y2 | 11/1997 |
| JP | 10-037868 | A | 2/1998 |
| JP | 2000-054972 | A | 2/2000 |
| WO | WO 2017/126181 | A1 | 7/2017 |

OTHER PUBLICATIONS

International Search Report dated Apr. 26, 2016 in PCT/JP2016/051865, filed on Jan. 22, 2016.

* cited by examiner $\theta = 180$deg $\theta = 270$deg

OPEN TO SUCTION CHAMBER 70a

OPEN TO SUCTION CHAMBER 70b $\theta = 270deg$

SPIRAL HORIZONTAL PLANE

B-B CROSS SECTION

SPIRAL HORIZONTAL PLANE

C-C CROSS SECTION

SPIRAL HORIZONTAL PLANE

D-D CROSS SECTION

SPIRAL HORIZONTAL PLANE

E-E CROSS SECTION

SPIRAL HORIZONTAL PLANE

F-F CROSS SECTION

SCROLL COMPRESSOR AND REFRIGERATION CYCLE APPARATUS INCLUDING INJECTION PORT OPENING INTO SUCTION CHAMBER

TECHNICAL FIELD

The present invention relates to a low-pressure shell scroll compressor including an injection port and also to a refrigeration cycle apparatus.

BACKGROUND ART

In a conventional air-conditioning apparatus, such as a multi-air-conditioning apparatus for buildings, an outdoor unit serving as heat source device, installed outside a building and an indoor unit installed inside the building are connected by pipes to form a refrigerant circuit. The air-conditioning apparatus circulates refrigerant in the refrigerant circuit, heats or cools air using heat rejection or heat reception of the refrigerant, and thereby heats or cools an air-conditioned space.

In a place under low outside air temperature conditions, such as in cold climates, a scroll compressor used in an air-conditioning apparatus, such as that described above, is difficult to operate because of a high discharge temperature that exceeds an allowable temperature. To allow the scroll compressor to operate under low outside air temperature conditions, appropriate measures need to be taken to reduce the discharge temperature.

Patent Literatures 1, 2, and 3 each disclose a low-pressure shell structure in which suction refrigerant is temporarily drawn into the shell and then sucked into a compression chamber. This structure is configured such that the refrigerant is injected into the compressor to reduce the discharge temperature.

Patent Literature 1 discloses a structure in which the outlet of an injection pipe is disposed to face a suction chamber in a compression mechanism.

Patent Literature 2 discloses a structure in which the outlet of an injection pipe communicates with an injection port in a fixed scroll baseplate so that injection refrigerant discharged from the injection pipe directly flows through the injection port into a compression chamber in a compression mechanism.

Patent Literature 3 discloses a structure having substantially the same configuration as that in Patent Literature 2. The structure disclosed in Patent Literature 3 is configured such that an injection port communicates with a compression chamber in most rotation phases in one rotation and communicates with a suction chamber in a particular rotation phase.

CITATION LIST

Patent Literature

Patent Literature 1: Japanese Unexamined Patent Application Publication No. 2000-54972

Patent Literature 2: Japanese Unexamined Patent Application Publication No. 60-166778

Patent Literature 3: Japanese Unexamined Patent Application Publication No. 10-37868

SUMMARY OF INVENTION

Technical Problem

In the technique disclosed in Patent Literature 1, where the injection port is distant from the suction chamber, injection refrigerant is not easily drawn into the suction chamber. Because of the low-pressure shell structure, liquid refrigerant overflowing from the suction chamber flows down into an oil sump at the bottom of a container filled with refrigerating machine oil. As a result, the refrigerating machine oil is diluted with the liquid refrigerant. Consequently, the viscosity of the refrigerating machine oil fed to a sliding portion, such as a bearing, is lowered, and the reliability of the compressor is degraded.

In the technique disclosed in Patent Literature 2, where the injection port communicates only with the compression chamber and does not communicate with the suction chamber, there is no risk of dilution of refrigerating machine oil in the oil sump. However, the volume of the injection pipe and the injection port is a dead volume that does not contribute to compressing refrigerant. Consequently, when no injection operation is performed, unnecessary work is carried out during compression of refrigerant accumulated in the dead volume, and thus degrading performance of the compressor.

In the technique disclosed in Patent Literature 3, the injection port communicates with the compression chamber in most rotation phases in one rotation. Consequently, as in Patent Literature 2, when no injection operation is performed, unnecessary work is carried out during compression of refrigerant accumulated in the dead volume, and again thus degrading performance of the compressor.

The present invention has been made to solve the problems described above. An object of the present invention is to obtain a scroll compressor that can reduce the outflow of injection refrigerant into the oil sump, reduce degradation of reliability associated with a decrease in the viscosity of refrigerating machine oil stored in the oil sump, reduce degradation of performance caused by compression of dead volume, and thereby achieve high efficiency, and to also obtain a refrigeration cycle apparatus.

Solution to Problem

A scroll compressor according to an embodiment of the present invention includes a hermetic container into which refrigerant gas is drawn through a suction pipe, a compression mechanism disposed in the hermetic container, including a fixed scroll and an orbiting scroll, and configured to compress the refrigerant gas, a motor mechanism disposed in the hermetic container, a rotation shaft configured to transmit torque of the motor mechanism to the orbiting scroll, and an injection port for introducing refrigerant flowing into the compression mechanism through an injection pipe that is different from the suction pipe. The fixed scroll and the orbiting scroll each include a baseplate and a spiral body. The compression mechanism has a compression chamber and a suction chamber. The compression chamber is closed between the spiral body of the fixed scroll and the spiral body of the orbiting scroll, and the suction chamber is unclosed and into which the refrigerant gas in the hermetic container is sucked. The injection port opens only to the suction chamber and is provided in the baseplate of the fixed scroll. In all phases of rotation of the rotation shaft, the injection port is located on an inner side of an outer edge of a structure unit that is configured by meshing the spiral body of the fixed scroll and the spiral body of the orbiting scroll with each other.

A refrigeration cycle apparatus according to an embodiment of the present invention includes a main circuit sequentially connecting the scroll compressor described above, a condenser, a pressure reducing device, and an evaporator, to allow the refrigerant to circulate through the main circuit, an injection circuit branching off from a part between the condenser and the pressure reducing device, and connected to the injection port in the scroll compressor, and a flow control valve configured to control a flow rate in the injection circuit.

Advantageous Effects of Invention

With the scroll compressor and the refrigeration cycle apparatus according to an embodiment of the present invention, it is possible to obtain a scroll compressor that can reduce the outflow of injection refrigerant toward the oil sump, reduce degradation of reliability associated with a decrease in the viscosity of refrigerating machine oil stored in the oil sump, reduce degradation of performance caused by compression of dead volume, and thereby achieve high efficiency, and to also obtain a refrigeration cycle apparatus.

DESCRIPTION OF EMBODIMENTS

Figure 1:
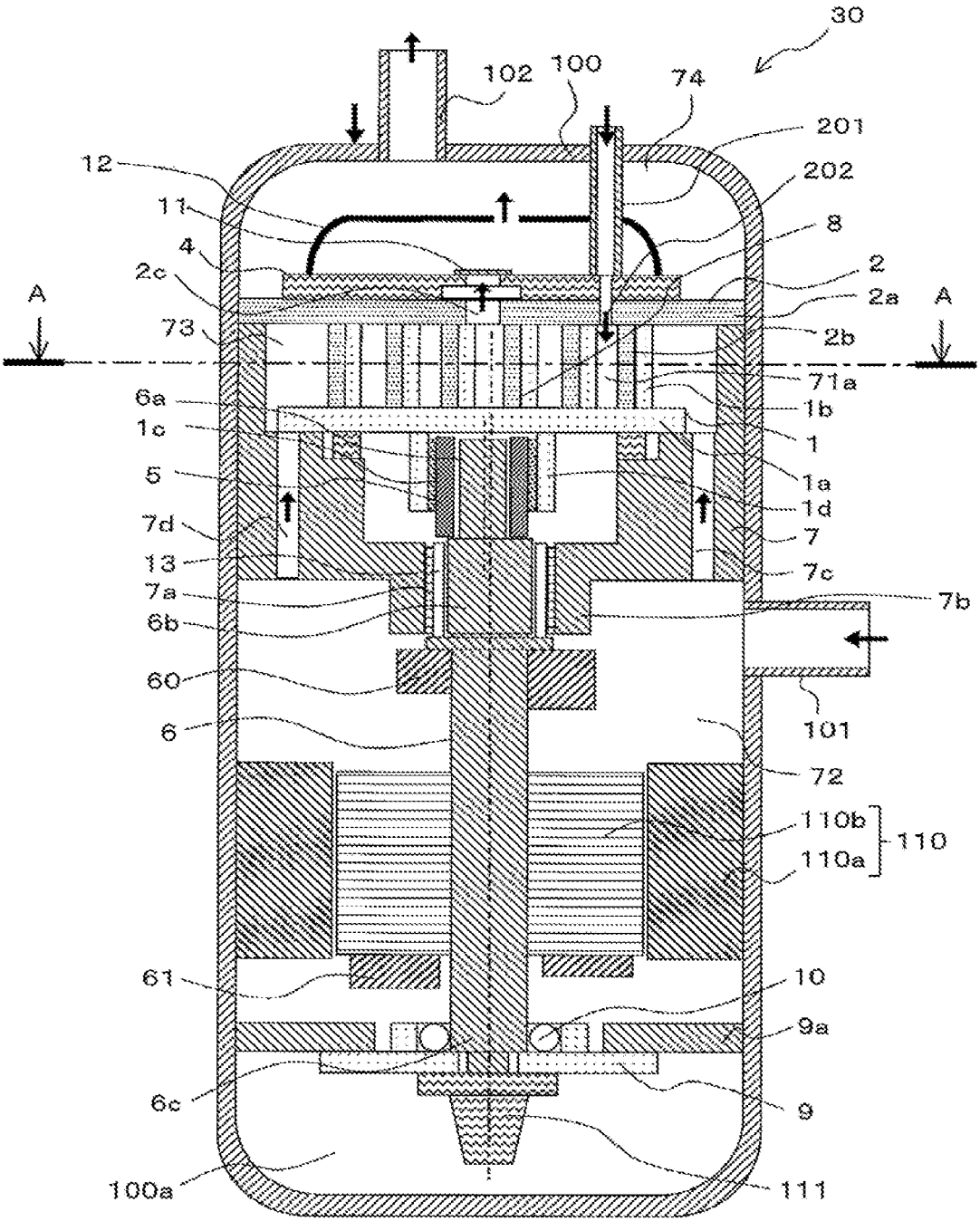
FIG. 1 is a schematic longitudinal cross-sectional view illustrating an overall configuration of a scroll compressor according to Embodiment 1 of the present invention.

Hereinafter, scroll compressors and refrigeration cycle apparatuses according to Embodiments 1 to 8 of the present invention will be described with reference to the drawings. In the drawings to be referred to including FIG. 1, components denoted by the same reference signs are the same or corresponding ones and are common throughout the following description of Embodiments 1 to 8. Note that constituent elements described throughout the specification are merely examples, and are not intended to limit the present invention to those described in the specification.

Embodiment 1

Figure 2:
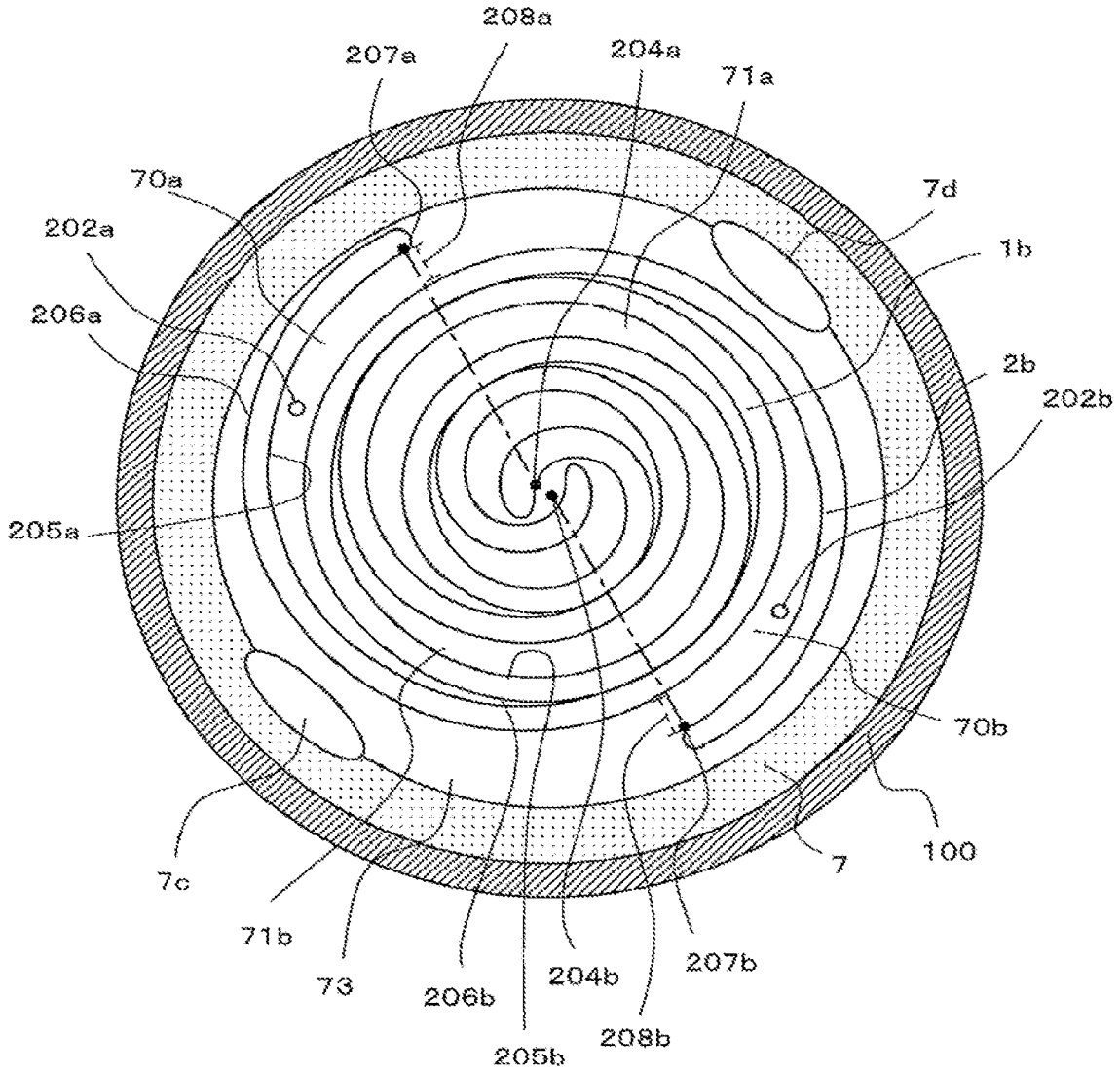
FIG. 2 is a diagram illustrating a compression mechanism and its vicinity in the scroll compressor according to Embodiment 1 of the present invention.

FIG. 1 is a schematic longitudinal cross-sectional view illustrating an overall configuration of a scroll compressor 30 according to Embodiment 1 of the present invention. FIG. 2 is a diagram illustrating a compression mechanism 8 and its vicinity in the scroll compressor 30 according to Embodiment 1 of the present invention.

The scroll compressor 30 of a low-pressure shell type according to Embodiment 1 includes the compression mechanism 8 including an orbiting scroll 1 and a fixed scroll 2, a motor mechanism 110 configured to drive the compression mechanism 8 through a rotation shaft 6, and other components. The scroll compressor 30 has a configuration in which these components are contained in a hermetic container 100 that defines an outer structure. In the hermetic container 100, the rotation shaft 6 transmits torque from the motor mechanism 110 to the orbiting scroll 1. The orbiting scroll 1 is eccentrically coupled to the rotation shaft 6 and orbits by the torque of the motor mechanism 110. The scroll compressor 30 is of a low-pressure shell type that is configured to temporarily draw sucked-in low-pressure refrigerant gas into the internal space of the hermetic container 100 and then compress the refrigerant gas.

The hermetic container 100 further contains a frame 7 and a sub-frame 9 that are disposed to face each other in the axial direction of the rotation shaft 6, with the motor mechanism 110 interposed between the frame 7 and the sub-frame 9. The frame 7 is disposed above the motor mechanism 110 and located between the motor mechanism 110 and the compression mechanism 8. The sub-frame 9 is disposed below the motor mechanism 110. The frame 7 is secured to the inner periphery of the hermetic container 100 by shrink fitting, welding, or other methods. The sub-frame 9 is secured through a sub-frame holder 9*a* to the inner periphery of the hermetic container 100 by shrink fitting, welding, or other methods.

A pump element 111 including a positive-displacement pump is attached to a lower side of the sub-frame 9 in such a manner that the rotation shaft 6 is removably supported in the axial direction by an upper end face of the pump element 111. The pump element 111 is configured to supply refrigerating machine oil stored in an oil sump 100*a* at the bottom of the hermetic container 100 to a sliding portion, such as a main bearing 7*a* described below of the compression mechanism 8.

The hermetic container 100 is provided with a suction pipe 101 for sucking in the refrigerant, a discharge pipe 102 for discharging the refrigerant, and an injection pipe 201. The refrigerant is drawn into the internal space of the hermetic container 100 through the suction pipe 101. The injection pipe 201 is for introducing the refrigerant into the compression mechanism 8 in the hermetic container 100, and is provided separately from the suction pipe 101. The compression mechanism 8 has injection ports 202 for introducing the refrigerant through the injection pipe 201.

The compression mechanism 8 has the function of compressing the refrigerant sucked in through the suction pipe 101, and discharging the compressed refrigerant to a high-pressure portion formed in an upper part of the interior of the hermetic container 100.

The compression mechanism 8 includes the orbiting scroll 1 and the fixed scroll 2.

The fixed scroll 2 is secured through the frame 7 to the hermetic container 100. The orbiting scroll 1 is disposed below the fixed scroll 2 and supported by an eccentric shaft portion 6*a* described below of the rotation shaft 6 to freely orbit.

The orbiting scroll 1 includes an orbiting baseplate 1*a* and an orbiting spiral body 1*b*, which is a scroll lap disposed upright on one surface of the orbiting baseplate 1*a*. The fixed scroll 2 includes a fixed baseplate 2*a* and a fixed spiral body 2*b*, which is a scroll lap disposed upright on one surface of the fixed baseplate 2*a*. The orbiting scroll 1 and the fixed scroll 2 are disposed in the hermetic container 100 in a symmetrical spiral shape formed by combining the orbiting spiral body 1*b* and the fixed spiral body 2*b* in opposite phases.

The center of a base circle of an involute curve traced by the orbiting spiral body 1*b* is a base circle center 204*a*. The center of a base circle of an involute curve traced by the fixed spiral body 2*b* is a base circle center 204*b*. As the base circle center 204*a* revolves around the base circle center 204*b*, the orbiting spiral body 1*b* orbits around the fixed spiral body 2*b* as illustrated in FIG. 3 described below. The movement of the orbiting scroll 1 during operation of the scroll compressor 30 is described in detail later.

A winding start of the orbiting spiral body 1*b* is an innermost end portion from the base circle center 204*a*, and a winding end of the orbiting spiral body 1*b* is an outermost end portion from the base circle center 204*a*. Similarly, a winding start of the fixed spiral body 2*b* is an innermost end portion from the base circle center 204*b*, and a winding end of the fixed spiral body 2*b* is an outermost end portion from the base circle center 204*b*.

In an inward surface 205*a* of the orbiting spiral body 1*b* of the orbiting scroll 1, a point closest to the winding end and with which an outward surface 206*b* of the fixed spiral body 2*b* of the fixed scroll 2 brings into contact during orbiting movement is a winding-end contact point 207*a*. In an inward surface 205*b* of the fixed spiral body 2*b* of the fixed scroll 2, a point closest to the winding end and with which an outward surface 206*a* of the orbiting spiral body 1*b* of the orbiting scroll 1 brings into contact during orbiting movement is a winding-end contact point 207*b*.

When the spiral body is viewed along the spiral from the base circle center to the winding end, a plurality of contact points are brought into contact with the inward surface 205*a* of the orbiting spiral body 1*b* and the outward surface 206*b* of the fixed spiral body 2*b*. That is, a gap between the inward surface 205*a* of the orbiting spiral body 1*b* and the outward surface 206*b* of the fixed spiral body 2*b* is divided by the plurality of contact points into a plurality of chambers.

When the spiral body is viewed along the spiral from the base circle center to the winding end, a plurality of contact points are brought into contact with the inward surface 205*b* of the fixed spiral body 2*b* and the outward surface 206*a* of the orbiting spiral body 1*b*. That is, a gap between the inward surface 205*b* of the fixed spiral body 2*b* and the outward surface 206*a* of the orbiting spiral body 1*b* is divided by the plurality of contact points into a plurality of chambers.

The winding-end contact point 207*a* of the orbiting spiral body 1*b* and the winding-end contact point 207*b* of the fixed spiral body 2*b* are disposed opposite each other, with the base circle center 204*a* and the base circle center 204*b* interposed between the winding-end contact point 207*a* and the winding-end contact point 207*b*. As the orbiting spiral body 1*b* and the fixed spiral body 2*b* have a symmetrical spiral shape, a plurality of pairs of chambers are formed between the orbiting spiral body 1*b* and the fixed spiral body 2*b*, and the pairs of chambers are each formed from the outside of the spiral, as illustrated in FIG. 2.

A suction port 208*a* is a plane passing through the winding-end contact point 207*a* and a point on the outward surface 206*b* of the fixed spiral body 2*b*, parallel to the vertical direction, which is the axial direction of the rotation shaft 6, and having the smallest area. A suction port 208*b* is a plane passing through the winding-end contact point 207*b* and a point on the outward surface 206*a* of the orbiting spiral body 1*b*, parallel to the vertical direction, which is the axial direction of the rotation shaft 6, and having the smallest area.

A suction chamber 70*a* is defined as a space surrounded by the suction port 208*a*, the inward surface 205*a* of the orbiting spiral body 1*b*, the outward surface 206*b* of the fixed spiral body 2*b*, the orbiting baseplate 1*a*, and the fixed baseplate 2*a*. A suction chamber 70*b* is defined as a space surrounded by the suction port 208*b*, the outward surface 206*a* of the orbiting spiral body 1*b*, the inward surface 205*b* of the fixed spiral body 2*b*, the orbiting baseplate 1*a*, and the fixed baseplate 2*a*.

When the spiral body is viewed along the spiral from the suction port 208*a* or suction port 208*b* at the winding end toward the winding start, an initial contact portion is present at which the fixed spiral body 2*b* and the orbiting spiral body 1*b* initially are brought into contact with each other. The suction chamber 70*a* is a space interposed between the initial contact portion and the suction port 208*a*. The suction chamber 70*b* is a space interposed between the initial contact portion and the suction port 208*b*. In other words, the suction chamber 70*a* is a space where the winding-end contact point 207*a* is spaced apart from the outward surface 206*b* of the fixed spiral body 2*b* to form the suction port 208*a*. Also, the suction chamber 70*b* is a space where the winding-end contact point 207*b* is spaced apart from the outward surface 206*a* of the orbiting spiral body 1*b* to form the suction port 208*b*. As described below, when the orbiting spiral body 1*b* rotates, the positions where the fixed spiral body 2*b* and the orbiting spiral body 1*b* are in contact with each other are moved and the width of the suction port 208*a* or suction port 208*b* is changed. The volume of the suction chamber 70*a* and the suction chamber 70*b* is thus changed by the rotation.

Note that the suction ports 208*a* and 208*b* are opening ports and the suction chambers 70*a* and 70*b* are open chambers. For this reason, the suction chambers 70*a* and 70*b* do not substantially change in pressure.

Compression chambers 71*a* are each defined as a space surrounded by the inward surface 205*a* of the orbiting spiral body 1*b*, the outward surface 206*b* of the fixed spiral body 2*b*, the orbiting baseplate 1*a*, and the fixed baseplate 2*a*. Compression chambers 71*b* are each defined as a space surrounded by the outward surface 206*a* of the orbiting spiral body 1*b*, the inward surface 205*b* of the fixed spiral body 2*b*, the orbiting baseplate 1*a*, and the fixed baseplate 2*a*.

As described above, when the spiral body is viewed along the spiral from the suction port 208*a* or suction port 208*b* at the winding end toward the winding start, contact portions are present at which the fixed spiral body 2*b* and the orbiting spiral body 1*b* are in contact with each other. The compression chambers 71*a* and 71*b* are spaces each interposed between two of the contact portions. As described below, when the orbiting spiral body 1*b* rotates, the positions where the fixed spiral body 2*b* and the orbiting spiral body 1*b* are in contact are moved and the volume of the compression chambers 71*a* and 71*b* is changed by the rotation.

Note that the compression chambers 71*a* and 71*b* are closed spaces and vary in volume. The compression chambers 71*a* and 71 *b* are thus chambers in which the pressure varies as the rotation shaft 6 rotates.

That is, in the state illustrated in FIG. 2, the outermost chambers are the suction chambers 70*a* and 70*b* and the remaining chambers are the compression chambers 71*a* and 71*b*.

As described above, the orbiting scroll 1 includes the orbiting spiral body 1*b* disposed on the orbiting baseplate 1*a*, and the fixed scroll 2 includes the fixed spiral body 2*b* disposed on the fixed baseplate 2*a*. The orbiting spiral body 1*b* and the fixed spiral body 2*b* are combined to form a plurality of chambers including the compression chambers 71*a* and 71*b*.

A baffle 4 is secured to a surface of the fixed baseplate 2*a* of the fixed scroll 2 opposite the orbiting scroll 1. The baffle 4 has a through hole communicating with a discharge port 2*c* of the fixed scroll 2, and the through hole is provided with a discharge valve 11. A discharge muffler 12 is mounted to cover the discharge port 2*c*.

The frame 7 has a thrust surface to which the fixed scroll 2 is secured. The thrust surface axially supports a thrust force acting on the orbiting scroll 1. The frame 7 has openings 7*c* and 7*d* passing through for introducing the refrigerant sucked through the suction pipe 101 into the compression mechanism 8.

The motor mechanism 110 that supplies a rotary drive force to the rotation shaft 6 includes a motor stator 110*a* and a motor rotor 110*b*. To obtain power from the outside, the motor stator 110*a* is connected by a lead wire (not shown) to a glass terminal (not shown) located between the frame 7 and the motor stator 110*a*. The motor rotor 110*b* is secured to the rotation shaft 6 by shrink fitting or other methods. For balancing the entire rotation system of the scroll compressor 30, a first balance weight 60 is secured to the rotation shaft 6 and a second balance weight 61 is secured to the motor rotor 110*b*.

The rotation shaft 6 includes the eccentric shaft portion 6*a* in the upper part of the rotation shaft 6, a main shaft portion 6*b*, and a sub-shaft portion 6*c* in the lower part of the rotation shaft 6. The orbiting scroll 1 is fitted to the eccentric shaft portion 6*a*, with a slider 5 and an orbiting bearing 1*c* interposed between the orbiting scroll 1 and the eccentric shaft portion 6*a*, so that the eccentric shaft portion 6*a* slides against the orbiting bearing 1*c*, with a film of refrigerating machine oil between the eccentric shaft portion 6*a* and the orbiting bearing 1*c*. The orbiting bearing 1*c* is secured inside a boss 1*d*, for example, by press-fitting a bearing material, such as copper-zinc alloy, used for slide bearings, and the orbiting scroll 1 orbits as the rotation shaft 6 rotates. The main shaft portion 6*b* is fitted into a main bearing 7*a* through a sleeve 13. The main bearing 7*a* is disposed on the inner periphery of a boss 7*b* of the frame 7. The main shaft portion 6*b* slides against the main bearing 7*a*, with a film of refrigerating machine oil between the main shaft portion 6*b* and the main bearing 7*a*. The main bearing 7*a* is secured inside the boss 7*b*, for example, by press-fitting a bearing material, such as copper-zinc alloy, used for slide bearings.

A sub-bearing 10 formed by a ball bearing is disposed on the upper side of the sub-frame 9. Under the motor mechanism 110, the sub-bearing 10 rotatably supports the rotation shaft 6 in the radial direction. The sub-bearing 10 may rotatably support the rotation shaft 6 with a bearing configuration other than the ball bearing. The sub-shaft portion 6*c* is fitted into the sub-bearing 10, and the sub-shaft portion 6*c* slides against the sub-bearing 10. The axial center of the main shaft portion 6*b* and sub-shaft portion 6*c* coincides with the axial center of the rotation shaft 6.

In Embodiment 1, spaces formed by orbiting movement of a scroll compression element, such as the compression mechanism 8, are defined as follows. That is, a housing space located in the hermetic container 100 and between the motor rotor 110*b* and the frame 7 is a first space 72, a space defined by the inner wall of the frame 7 and the fixed baseplate 2*a* is a second space 73, and a space between the discharge pipe 102 and the fixed baseplate 2*a* is a third space 74.

Operations of the compression mechanism 8 will be described below with reference to FIGS. 3A to 3D.

Figure 3A:
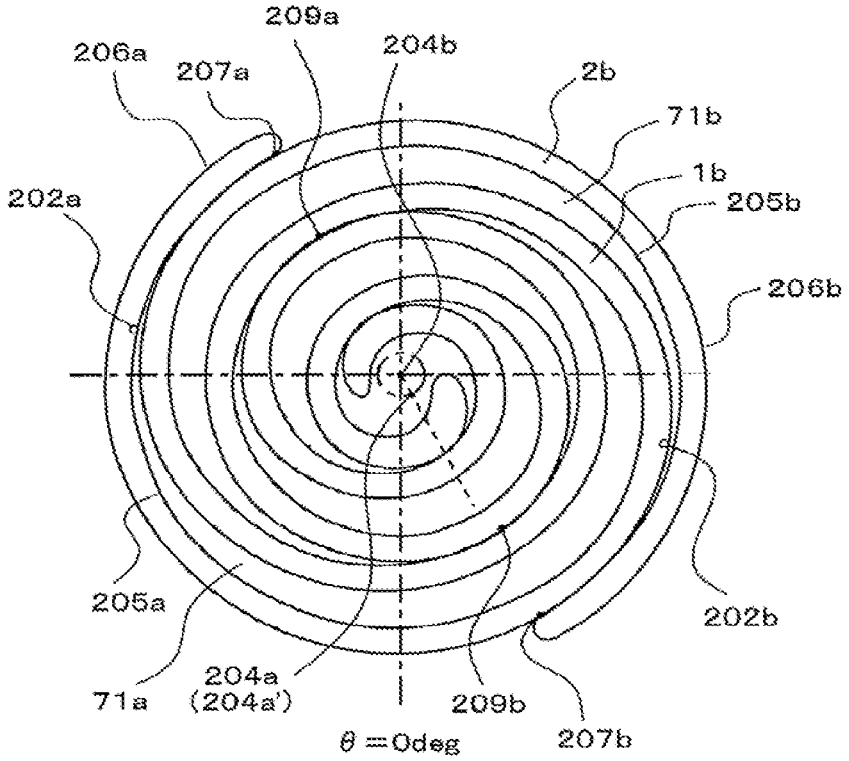
FIG. 3A is a compression process diagram illustrating an operation when a rotation phase θ is at 0 degrees in one rotation of an orbiting spiral body in a cross-section of the scroll compressor according to Embodiment 1 of the present invention, taken along line A-A in FIG. 1.
Figure 3B:
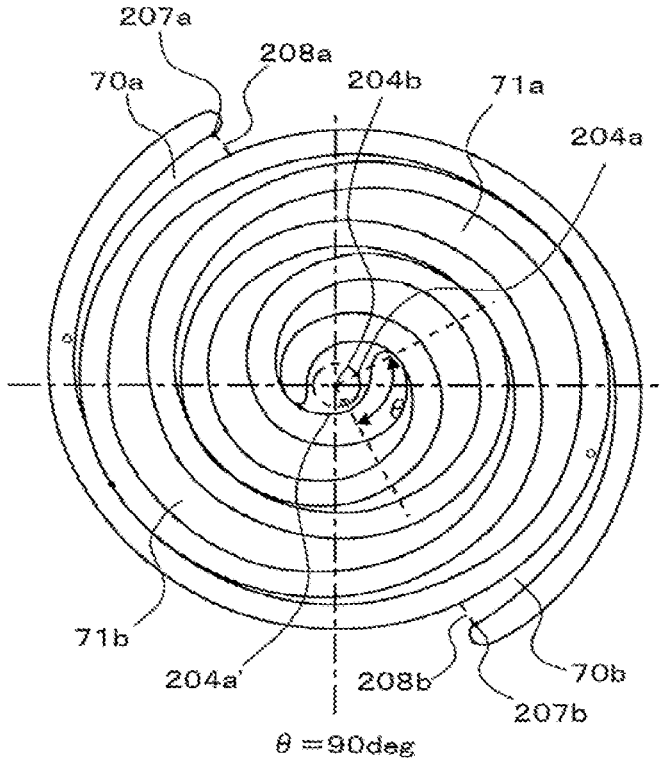
FIG. 3B is a compression process diagram illustrating an operation when the rotation phase θ is at 90 degrees in one rotation of the orbiting spiral body in the cross-section of the scroll compressor according to Embodiment 1 of the present invention, taken along line A-A in FIG. 1.
Figure 3C:
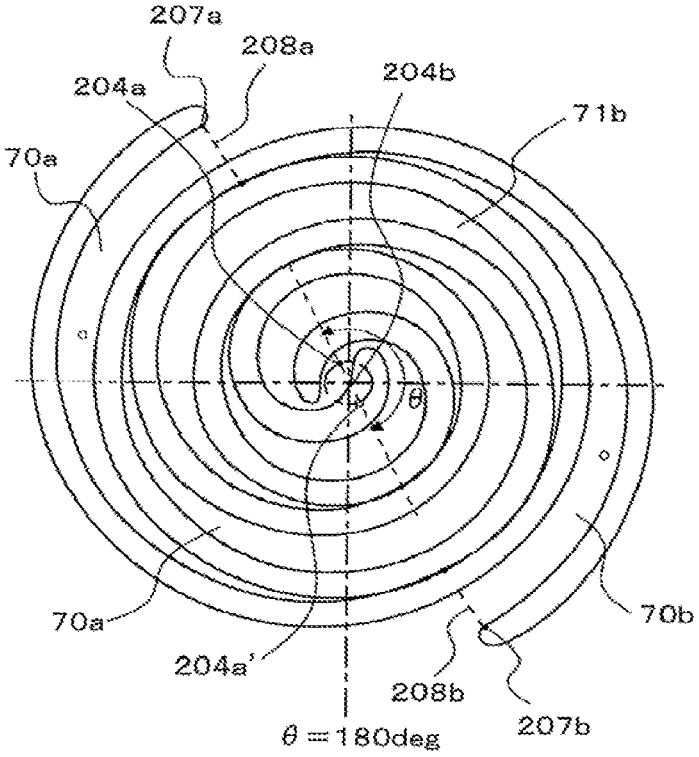
FIG. 3C is a compression process diagram illustrating an operation when the rotation phase θ is at 180 degrees in one rotation of the orbiting spiral body in the cross-section of the scroll compressor according to Embodiment 1 of the present invention, taken along line A-A in FIG. 1.
Figure 3D:
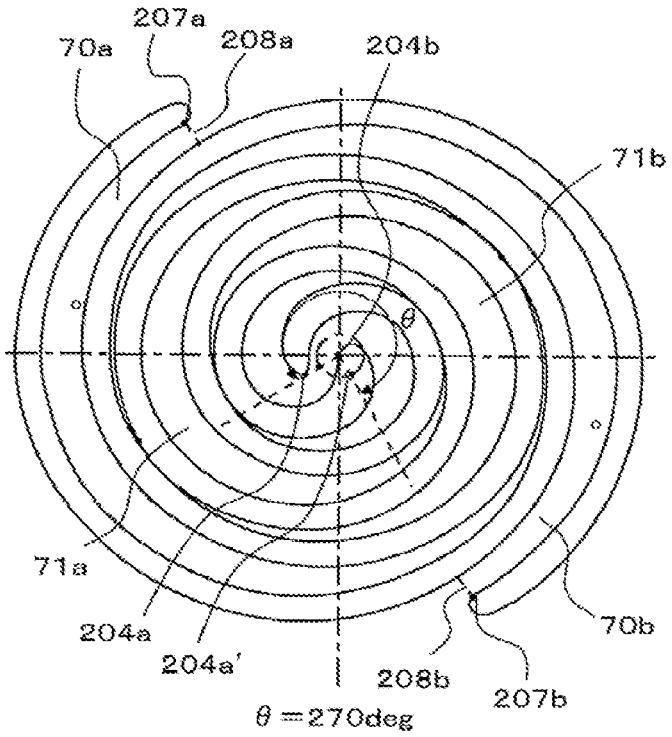
FIG. 3D is a compression process diagram illustrating an operation when the rotation phase θ is at 270 degrees in one rotation of the orbiting spiral body in the cross-section of the scroll compressor according to Embodiment 1 of the present invention, taken along line A-A in FIG. 1.

FIG. 3A is a compression process diagram illustrating an operation when a rotation phase θ is at 0 degrees in one rotation of the orbiting spiral body 1*b* in a cross-section of the scroll compressor 30 according to Embodiment 1 of the present invention, taken along line A-A in FIG. 1. FIG. 3B is a compression process diagram illustrating an operation when the rotation phase θ is at 90 degrees in one rotation of the orbiting spiral body 1*b* in the cross-section of the scroll compressor 30 according to Embodiment 1 of the present invention, taken along line A-A in FIG. 1. FIG. 3C is a compression process diagram illustrating an operation when the rotation phase θ is at 180 degrees in one rotation of the orbiting spiral body 1*b* in the cross-section of the scroll compressor 30 according to Embodiment 1 of the present invention, taken along line A-A in FIG. 1. FIG. 3D is a compression process diagram illustrating an operation when the rotation phase θ is at 270 degrees in one rotation of the orbiting spiral body 1*b* in the cross-section of the scroll compressor 30 according to Embodiment 1 of the present invention, taken along line A-A in FIG. 1.

A rotation phase θ is defined as an angle formed by a straight line connecting a base circle center of the orbiting spiral body 1*b* at the beginning of compression (i.e., base circle center 204*a*') with the base circle center 204*b* of the fixed spiral body 2*b* and a straight line connecting, at specific timing, the base circle center 204*a* of the orbiting spiral body 1*b* with the base circle center 204*b* of the fixed spiral body 2*b*. That is, the rotation phase θ is 0 degrees at the beginning of compression, and changes from 0 degrees to 360 degrees. FIGS. 3A to 3D illustrate how the orbiting spiral body 1*b* orbits as the rotation phase θ changes in order of 0 degrees, 90 degrees, 180 degrees, and 270 degrees.

When current is applied to the glass terminal (not shown) of the hermetic container 100, the motor rotor 110*b* causes the rotation shaft 6 to rotate. The torque of the motor rotor 110*b* is transmitted through the eccentric shaft portion 6*a* to the orbiting bearing 1*c*, and further transmitted from the orbiting bearing 1*c* to the orbiting scroll 1, and causes the orbiting scroll 1 to orbit. The refrigerant gas sucked through the suction pipe 101 into the hermetic container 100 is drawn into the suction chambers 70*a* and 70*b*.

In the state of FIG. 3A, where the outermost chambers are closed and suction of the refrigerant is completed, all chambers including the outermost chambers are the compression chambers 71*a* and 71*b*. In this case, when the compression chambers 71*a* and 71 *b* that are outermost chambers are focused, the compression chambers 71*a* and 71 *b* decrease in volume while moving in the direction from the outer periphery toward the center as the orbiting scroll 1 orbits. The refrigerant gas in the compression chambers 71*a* and 71*b* is compressed with a decrease in the volume of the compression chambers 71*a* and 71*b*.

Typically, in the scroll compressor 30, when the orbiting spiral body 1*b* and the fixed spiral body 2*b* are each viewed along the involute curve from the end at the outer periphery toward the spiral center, the two spiral bodies bring into contact with each other at a plurality of contact points. As illustrated in FIG. 3A, when the winding-end contact point 207*a* is in contact with the outward surface 206*b* or when the winding-end contact point 207*b* is in contact with the outward surface 206*a*, suction of the refrigerant is completed. At this time point, the suction ports 208*a* and 208*b* are closed and the outermost chambers are not the suction chambers 70*a* and 70*b*.

As illustrated in FIG. 3A, at the completion of suction, a space extending from the winding-end contact point 207*a*, which is the first contact point between the inward surface 205*a* of the orbiting spiral body 1*b* and the outward surface 206*b* of the fixed spiral body 2*b*, to a contact point 209*a*, which is the second contact point from the outside, is a closed space. Also, at the completion of suction, a space extending from the winding-end contact point 207*b*, which is the first contact point between the outward surface 206*a* of the orbiting spiral body 1*b* and the inward surface 205*b* of the fixed spiral body 2*b*, to a contact point 209*b*, which is the second contact point from the outside, is a closed space. However, when the suction ports 208*a* and 208*b* slightly open immediately before or immediately after completion of suction, the contact points 209*a* and 209*b* that are second from the outside at the completion of suction become the outermost contact points and communicate with the suction ports 208*a* and 208*b*, respectively.

The suction chambers 70*a* and 70*b* are spaces that are varied in volume by rotation of the orbiting spiral body 1*b*. That is, as the rotation phase θ increases, the suction chambers 70*a* and 70*b* increase in volume along respective directions of lines substantially tangent to the orbiting spiral body 1*b* and the fixed spiral body 2*b*, as illustrated in order of FIG. 3B, FIG. 3C, and FIG. 3D. As the volume increases, the suction chambers 70*a* and 70*b* sucks in the refrigerant gas in the hermetic container 100. When the suction ports 208*a* and 208*b* disappear and the volume of the suction chambers 70*a* and 70*b* is maximized at the time point of FIG. 3A, the suction chambers 70*a* and 70*b* transition to the compression chambers 71*a* and 71 *b*.

Because of the spiral shape, the compression chambers 71*a* and 71*b* decrease in volume toward the center, vary in volume as the rotation shaft 6 rotates as described above, and compress the refrigerant sucked in the compression chambers 71*a* and 71*b*. The compression chambers 71*a* and 71*b* closest to the center communicate with the discharge port 2*c* illustrated in FIG. 1. The compressed refrigerant is discharged from the discharge port 2*c* through the discharge valve 11 into the discharge muffler 12, and is then discharged into the third space 74.

The injection ports 202, which are a feature of the present invention, will be described below with reference to FIGS. 1 and 2.

The fixed baseplate 2*a* is provided with a pair of injection ports 202 formed by making holes toward the suction chambers 70*a* and 70*b*. From the outside of the scroll compressor 30, liquid or two-phase refrigerant flows through the injection pipe 201 into each of the injection ports 202. The injection ports 202 are each formed by making a hole such that the hole is not open to the compression chambers 71*a* and 71*b* and is open only to a corresponding one of the suction chambers 70*a* and 70*b* during one rotation.

The injection ports 202 formed in the fixed baseplate 2*a* are each repeatedly opened and closed as the rotation shaft 6 rotates, by an end portion of the orbiting spiral body 1*b* adjacent to the fixed baseplate 2*a* (i.e., by a tooth tip that is an end portion of the orbiting spiral body 1*b* in the axial direction). When the port width in the radial direction is smaller than the spiral body thickness of the orbiting spiral body 1*b*, the injection ports 202 are completely closed in a given range of rotation angle of the rotation shaft 6. Note that the spiral body thickness of the orbiting spiral body 1*b* is the minimum distance between the inward surface 205*a* and the outward surface 206*a* defined by the involute curve of the orbiting spiral body 1*b*.

In all phases of rotation of the rotation shaft 6, the injection ports 202 are located on an inner side of the outer edge of a structure unit configured by meshing the orbiting spiral body 1*b* and the fixed spiral body 2*b* of the compression mechanism 8 with each other.

Of the injection ports 202, one that communicates with the suction chamber 70*a* is defined as an injection port 202*a*, and the other that communicates with the suction chamber 70*b* is defined as an injection port 202*b*. In the drawings to be referred to, the injection ports 202*a* and 202*b* are always indicated by open circles to clarify their positions, regardless of the positional relation with the orbiting spiral body 1*b*.

The tooth tip of the orbiting spiral body 1*b* (i.e., the end portion of the orbiting spiral body 1*b* in the axial direction) and the fixed baseplate 2*a* facing the tooth tip are in contact in such a manner that the tooth tip slides against the fixed baseplate 2*a*. At the same time, the tooth tip of the fixed spiral body 2*b* (i.e., the end portion of the fixed spiral body 2*b* in the axial direction) and the orbiting baseplate 1*a* facing the tooth tip are in contact in such a manner that the tooth tip slides against the orbiting baseplate 1*a*. With this configuration, the suction chambers 70*a* and 70*b* and the compression chambers 71*a* and 71*b* are sealed. The orbiting spiral body 1*b* and the fixed spiral body 2*b* are formed to have an appropriate thickness to ensure strength, and the tooth tip portion of each of the orbiting spiral body 1*b* and the fixed spiral body 2*b* for sealing has a flat surface having a width corresponding to the thickness.

Figure 4A:
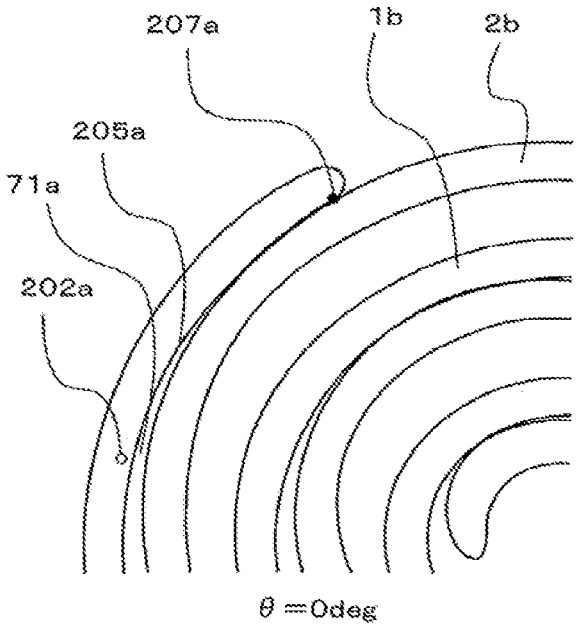
FIG. 4A is a compression process diagram illustrating an operation when a rotation phase θ is at 0 degrees in one rotation of the orbiting spiral body in the vicinity of an injection port in the cross-section of the scroll compressor according to Embodiment 1 of the present invention, taken along line A-A in FIG. 1.
Figure 4B:
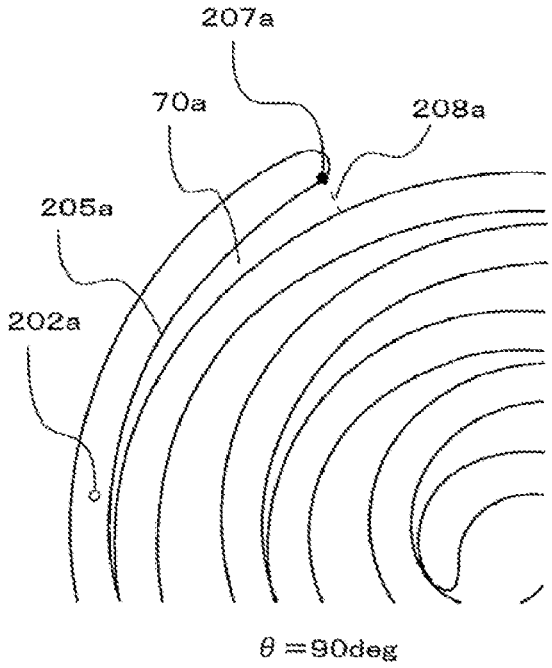
FIG. 4B is a compression process diagram illustrating an operation when the rotation phase θ is at 90 degrees in one rotation of the orbiting spiral body in the vicinity of the injection port in the cross-section of the scroll compressor according to Embodiment 1 of the present invention, taken along line A-A in FIG. 1.
Figure 4C:
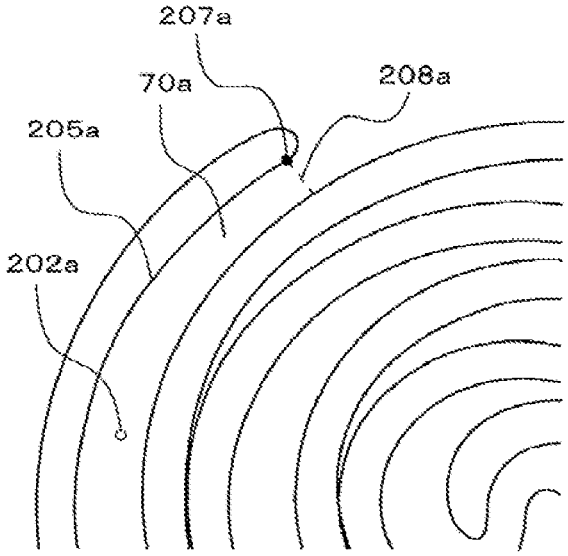
FIG. 4C is a compression process diagram illustrating an operation when the rotation phase θ is at 180 degrees in one rotation of the orbiting spiral body in the vicinity of the injection port in the cross-section of the scroll compressor according to Embodiment 1 of the present invention, taken along line A-A in FIG. 1.
Figure 4D:
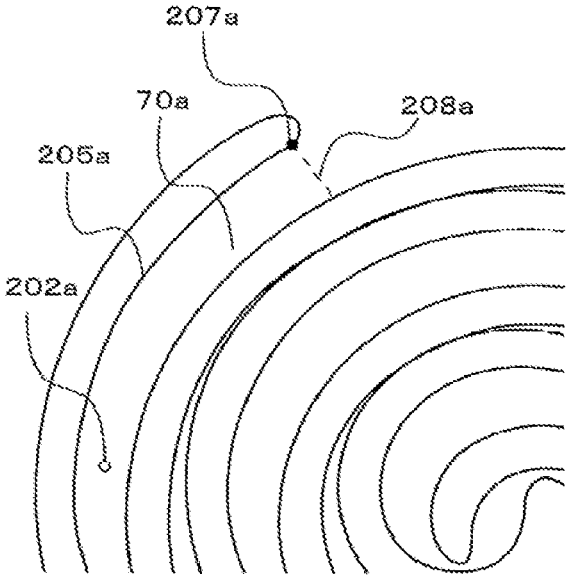
FIG. 4D is a compression process diagram illustrating an operation when the rotation phase θ is at 270 degrees in one rotation of the orbiting spiral body in the vicinity of the injection port in the cross-section of the scroll compressor according to Embodiment 1 of the present invention, taken along line A-A in FIG. 1.
Figure 5:
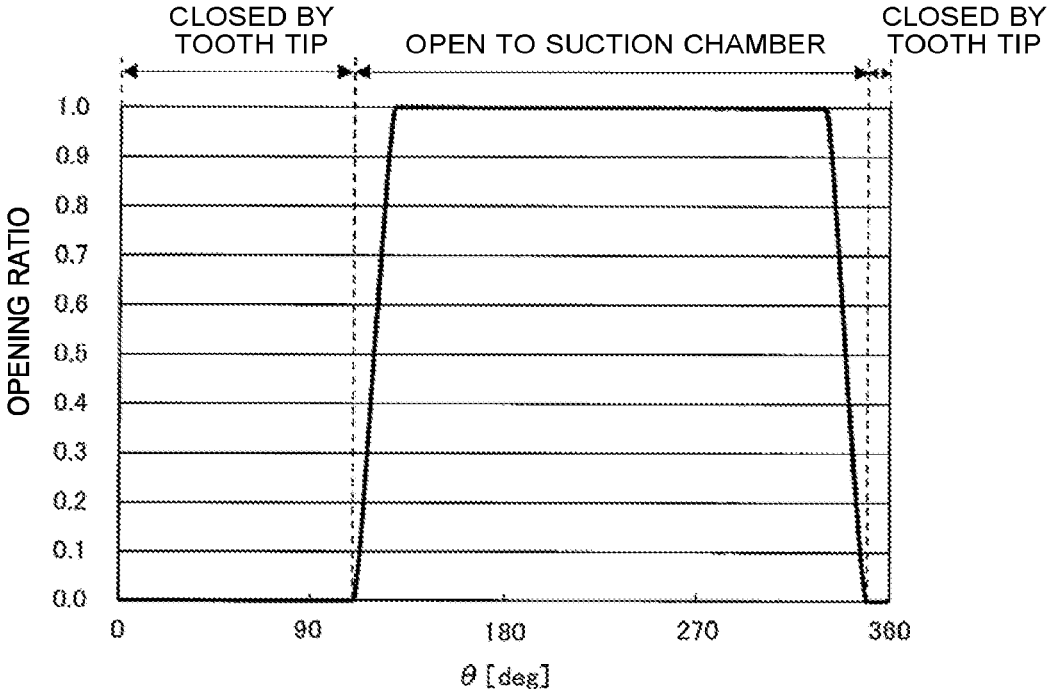
FIG. 5 is a diagram illustrating an injection port opening ratio in the scroll compressor according to Embodiment 1 of the present invention.

With reference to FIGS. 4 and 5, the operation of opening and closing the injection ports 202 will be described below. While only the injection port 202*a* communicating with the suction chamber 70*a* is shown in FIG. 4, the operation of opening and closing the injection port 202*b* communicating with the suction chamber 70*b* is performed in the same manner.

FIG. 4A is a compression process diagram illustrating an operation when a rotation phase θ is at 0 degrees in one rotation of the orbiting spiral body 1*b* in the vicinity of the injection port 202*a* in the cross-section of the scroll compressor 30 according to Embodiment 1 of the present invention, taken along line A-A in FIG. 1. FIG. 4B is a compression process diagram illustrating an operation when the rotation phase θ is at 90 degrees in one rotation of the orbiting spiral body 1*b* in the vicinity of the injection port 202*a* in the cross-section of the scroll compressor 30 according to Embodiment 1 of the present invention, taken along line A-A in FIG. 1. FIG. 4C is a compression process diagram illustrating an operation when the rotation phase θ is at 180 degrees in one rotation of the orbiting spiral body 1*b* in the vicinity of the injection port 202*a* in the cross-section of the scroll compressor 30 according to Embodiment 1 of the present invention, taken along line A-A in FIG. 1. FIG. 4D is a compression process diagram illustrating an operation when the rotation phase θ is at 270 degrees in one rotation of the orbiting spiral body 1*b* in the vicinity of the injection port 202*a* in the cross-section of the scroll compressor 30 according to Embodiment 1 of the present invention, taken along line A-A in FIG. 1. FIG. 5 is a diagram illustrating an injection port opening ratio in the scroll compressor 30 according to Embodiment 1 of the present invention.

The opening ratio of the injection port 202*a* is the ratio of the area of the injection port 202*a*, which is open to the suction chamber 70*a*, to the total area of the injection port 202*a*.

When the rotation phase θ is at 0 degrees, the injection port 202*a* is completely closed by the orbiting spiral body 1*b* as illustrated in FIG. 4A. The outermost chamber at this time point is one of the compression chambers 71*a*. As the rotation phase θ advances, the injection port 202*a* begins to open to the suction chamber 70*a* when the rotation phase θ is about 110 degrees. Then, the opening ratio gradually increases and the injection port 202*a* completely opens when the rotation phase θ is about 130 degrees. The rotation phase θ further advances, and the injection port 202*a* is completely closed by the orbiting spiral body 1*b* when the rotation phase θ is about 350 degrees. When the rotation phase θ is at 180 degrees and when the rotation phase θ is at 270 degrees, as illustrated in FIGS. 4C and 4D, the injection port 202*a* completely opens to the suction chamber 70*a*. The same operation as above is repeated when and after the rotation phase θ is at 360 degrees.

That is, the injection ports 202*a* and 202*b* open only when the winding-end contact points 207*a* and 207*b* each between the orbiting spiral body 1*b* and the fixed spiral body 2*b* are each spaced apart from a corresponding one of the fixed spiral body 2*b* and the orbiting spiral body 1*b* to form the suction chambers 70*a* and 70*b*, as the orbiting scroll 1 orbits.

Also, as the orbiting scroll 1 orbits, the injection ports 202*a* and 202*b* are closed by being covered with the orbiting spiral body 1*b* while the winding-end contact points 207*a* and 207*b* each between the orbiting spiral body 1*b* and the fixed spiral body 2*b* are each in contact with a corresponding one of the fixed spiral body 2*b* and the orbiting spiral body 1*b*.

The installation positions of the injection ports 202*a* and 202*b* will be described below.

Figure 6A:
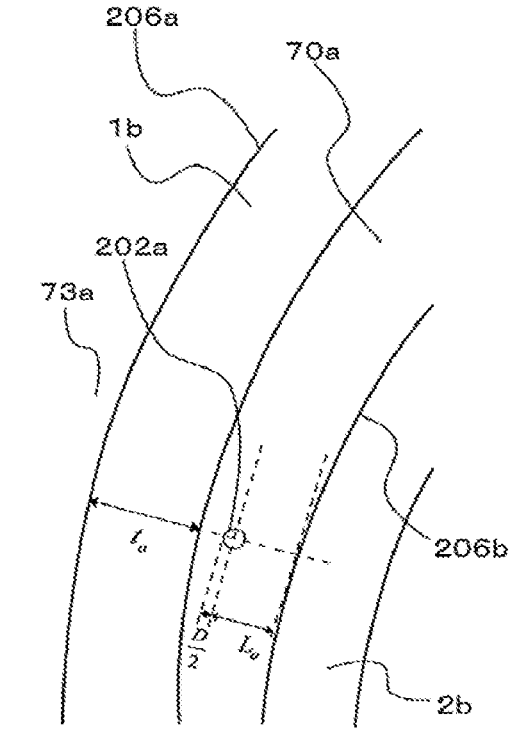
FIG. 6A is a diagram illustrating constraints on the installation position of an injection port in the scroll compressor according to Embodiment 1 of the present invention.

FIG. 6A is a diagram illustrating constraints on the installation position of the injection port 202*a* in the scroll compressor 30 according to Embodiment 1 of the present invention. FIG. 6A is an enlarged view of the injection port 202*a*, which is open to the suction chamber 70*a*, and its neighboring region.

A position that is radially outside the outward surface 206*a* of the orbiting spiral body 1*b* forming the outermost chamber faces the second space 73, which is a region serving neither as the suction chamber 70*a* nor as one of the compression chambers 71*a* during one rotation of the rotation shaft 6. Consequently, when the injection port 202*a* is at this position, the injection port 202*a* passes across the orbiting spiral body 1*b* and injection refrigerant leaks to the second space 73 in a particular rotation phase θ in one rotation. In horizontal plan view, consequently, the injection port 202*a* should not cross the outward surface 206*a* of the orbiting spiral body 1*b* in any rotation phase θ of the rotation shaft 6. Thus, inequality (1) "$L_o<t_o-D/2$" needs to be satisfied, where D is the outside diameter of the injection port 202*a*, $L_o$ is the distance of the center of the injection port 202*a* from the outward surface 206*b* of the fixed spiral body 2*b*, and $t_o$ is the spiral body thickness of the orbiting spiral body 1*b*.

Figure 6B:
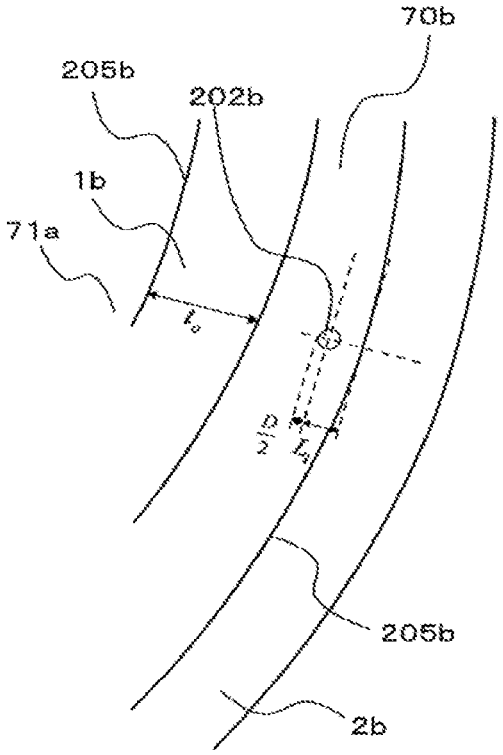
FIG. 6B is a diagram illustrating constraints on the installation position of the other injection port in the scroll compressor according to Embodiment 1 of the present invention.

FIG. 6B is a diagram illustrating constraints on the installation position of the injection port 202*b* in the scroll compressor 30 according to Embodiment 1 of the present invention. FIG. 6B is an enlarged view of the injection port 202*b*, which is open to the suction chamber 70*b*, and its neighboring region.

A position that is radially inside the inward surface 205*b* of the orbiting spiral body 1*b* forming the outermost chamber faces one of the compression chambers 71*a*. Consequently, when the injection port 202*b* is at this position, the injection port 202*b* passes across the orbiting spiral body 1*b* and injection refrigerant leaks to one of the compression chambers 71*b* at a particular rotation phase θ in one rotation. In horizontal plan view, consequently, the injection port 202*b* should not cross the inward surface 205*b* of the orbiting spiral body 1*b* in any rotation phase θ of the rotation shaft 6. Thus, inequality (2) "$L_i<t_o-D/2$" needs to be satisfied, where D is the outside diameter of the injection port 202*b*, $L_i$ is the distance of the center of the injection port 202*b* from the inward surface 205*b* of the fixed spiral body 2*b*, and $t_o$ is the spiral body thickness of the orbiting spiral body 1*b*.

The range of an injection port installation angle α will be described below.

Figure 7:
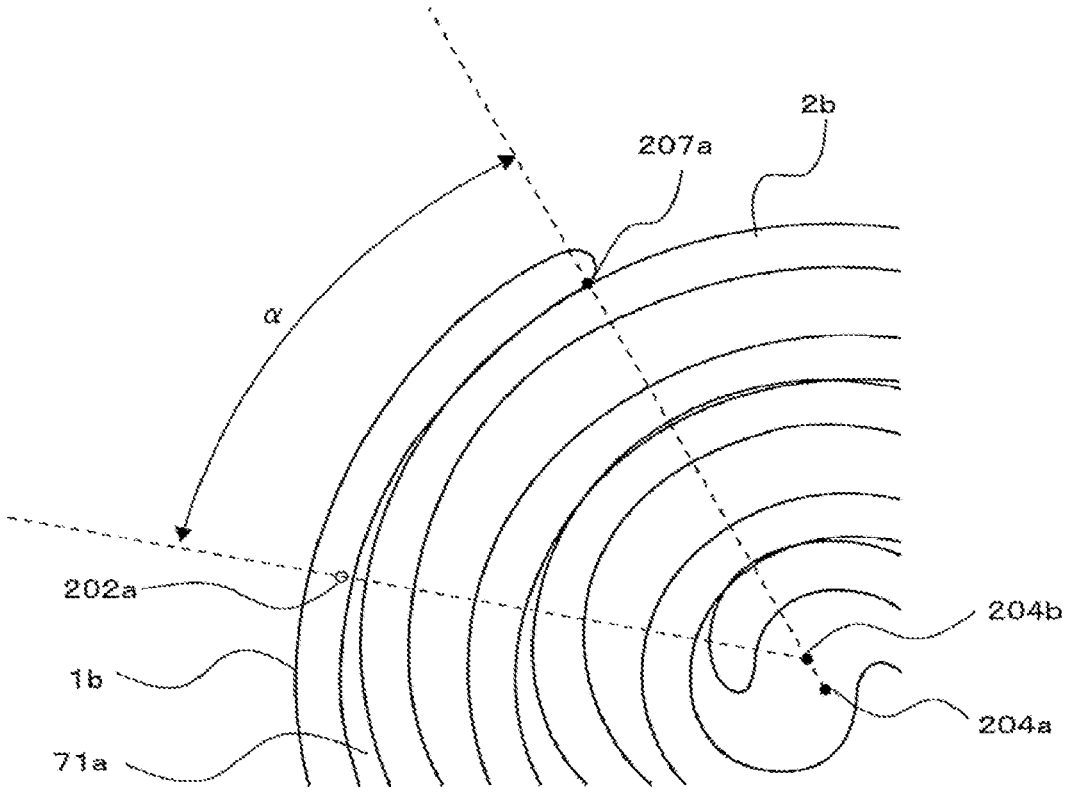
FIG. 7 is a diagram illustrating an injection port installation angle in the scroll compressor according to Embodiment 1 of the present invention.

FIG. 7 is a diagram illustrating the injection port installation angle α in the scroll compressor 30 according to Embodiment 1 of the present invention.

The installation angle α of the injection port 202*a* is an angle formed by a straight line connecting the winding-end contact point 207*a* when the rotation phase θ is at 0 degrees with the base circle center 204*b* and a straight line connecting the center of the injection port 202*a* with the base circle center 204*b*.

While not shown, the installation angle α of the injection port 202*b* is an angle formed similarly by a straight line connecting the winding-end contact point 207*b* when the rotation phase θ is at 0 degrees with the base circle center 204*a* and a straight line connecting the center of the injection port 202*b* with the base circle center 204*a*.

The larger the installation angle α is, the less likely it is, obviously, that refrigerant injected from the injection ports 202*a* and 202*b* will leak through the suction ports 208*a* and 208*b* to the second space 73. Thus, it is desirable that the installation angle α be large, and $L_o$ and $L_i$ need to be increased to increase the installation angle α.

However, a has an upper limit due to the constraints given by inequalities (1) and (2), and the largest possible value of α is about 110 degrees in practice.

A relation between the injection port installation angle α and the injection port opening area will be described below.

Figure 8:
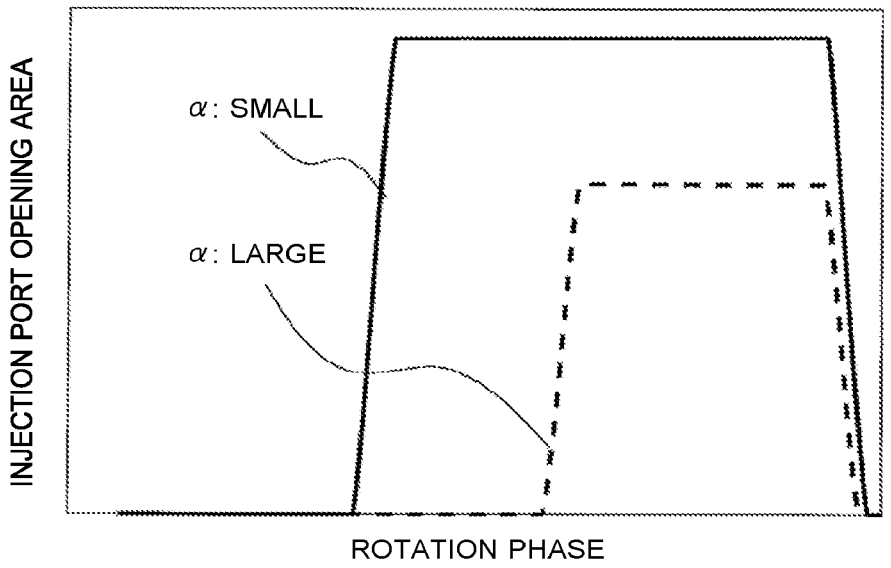
FIG. 8 is a diagram illustrating a relation between a rotation phase and an injection port opening area at different injection port installation angles in the scroll compressor according to Embodiment 1 of the present invention.

FIG. 8 is a diagram illustrating a relation between the rotation phase θ and the injection port opening area at different injection port installation angles α in the scroll compressor 30 according to Embodiment 1 of the present invention.

A solid line represents the case of a large installation angle α, and a broken line represents the case of a small installation angle α. When the installation angle α is large, $L_o$ and $L_i$ are increased as described above, and the outside diameter D of the injection ports 202*a* and 202*b* is inevitably reduced due to the constraints given by inequalities (1) and (2).

On the other hand, when the installation angle α is small, $L_o$ and $L_i$ can be reduced and the outside diameter D of the injection ports 202*a* and 202*b* can be increased. Consequently, when the injection port installation angle α is too large, $L_o$ and $L_i$ are increased, the injection port 202*a* opens to the suction chamber 70*a*, and the injection port 202*b* opens to the suction chamber 70*b* only within a limited rotation phase range. Moreover, due to the small outside diameter D of the injection ports 202*a* and 202*b*, the amount of injection per rotation is reduced. To increase the amount of injection to some extent, the injection port installation angle α preferably ranges from about 0 degrees to about 60 degrees.

Figure 9:
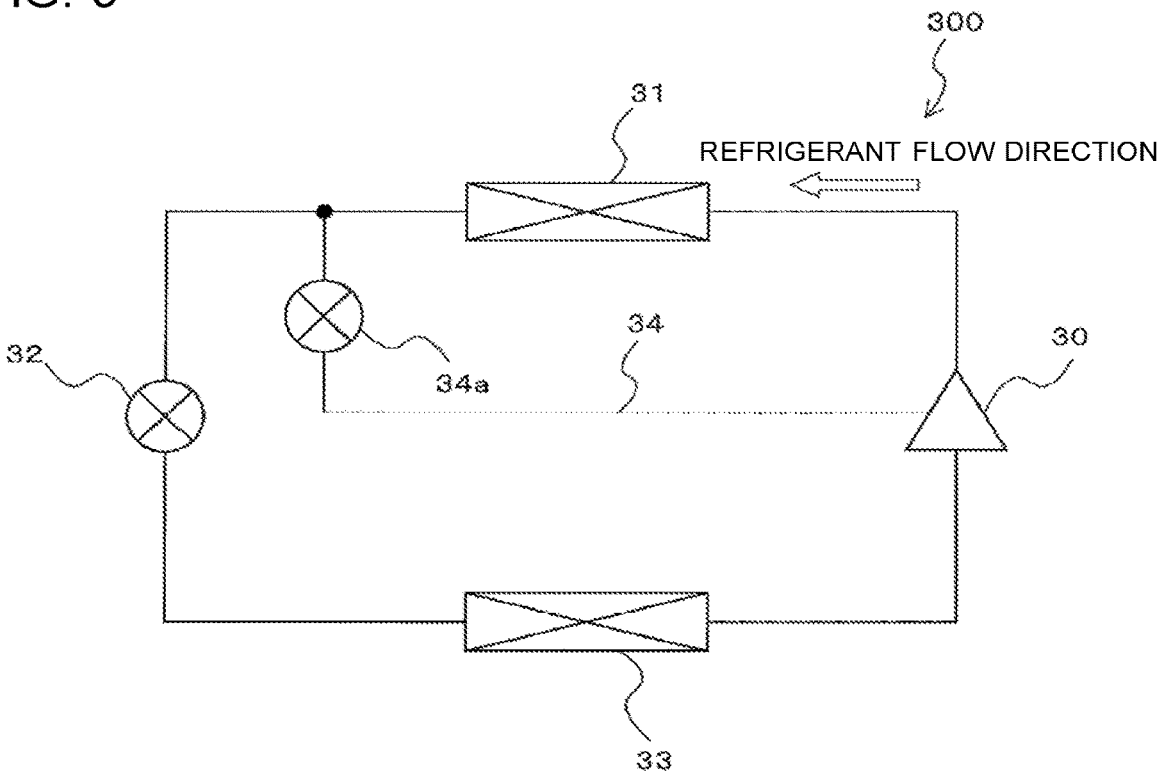
FIG. 9 illustrates an example configuration of a refrigeration cycle apparatus including an injection circuit that includes the scroll compressor according to Embodiment 1 of the present invention.

FIG. 9 illustrates an example configuration of a refrigeration cycle apparatus 300 including an injection circuit 34 that includes the scroll compressor 30 according to Embodiment 1 of the present invention.

The refrigeration cycle apparatus 300 illustrated in FIG. 9 includes a circuit including the scroll compressor 30, a condenser 31, an expansion valve 32 serving as a pressure reducing device, and an evaporator 33, and configured in such a manner that these components are sequentially connected by pipes to allow refrigerant to circulate through the circuit.

The refrigeration cycle apparatus 300 also includes the injection circuit 34 that branches off from the part between the condenser 31 and the expansion valve 32 and is connected to the scroll compressor 30.

The injection circuit 34 includes an expansion valve 34*a* serving as a flow control valve, and is capable of controlling the flow rate of injection into the suction chambers 70*a* and 70*b*.

The opening degree of the expansion valve 32, the opening degree of the expansion valve 34*a*, and the rotation frequency of the scroll compressor 30 are controlled by a controller (not shown).

The refrigeration cycle apparatus 300 may further include a four-way valve (not shown) for reversing the direction of refrigerant flow. In this case, a heating operation is performed when the condenser 31 disposed downstream of the scroll compressor 30 is on the indoor unit side and the evaporator 33 is on the outdoor unit side, whereas a cooling operation is performed when the condenser 31 is on the outdoor unit side and the evaporator 33 is on the indoor unit side. An injection operation is typically performed during heating operation, but may be performed during cooling operation.

Hereinafter, a circuit including the scroll compressor 30, the condenser 31, the expansion valve 32, and the evaporator 33 will be referred to as a main circuit, and refrigerant circulating through the main circuit will be referred to as main refrigerant. Refrigerant flowing through the injection circuit 34 will be referred to as injection refrigerant.

A flow of refrigerant will be described below.

(Flow of Main Refrigerant)

In the main circuit, main refrigerant discharged from the scroll compressor 30 passes through the condenser 31, the expansion valve 32, and the evaporator 33 and returns to the scroll compressor 30. The refrigerant returning to the scroll compressor 30 flows through the suction pipe 101 into the hermetic container 100.

Low-pressure refrigerant flowing through the suction pipe 101 into the first space 72 in the hermetic container 100 passes through the two openings 7*c* and 7*d* in the frame 7 and flows into the second space 73. As the orbiting spiral body 1*b* and the fixed spiral body 2*b* of the compression mechanism 8 relatively orbit, the low-pressure refrigerant flowing into the second space 73 is sucked into the suction chambers 70*a* and 70*b*. The main refrigerant sucked in the suction chambers 70*a* and 70*b* is increased in pressure from a low to high level by a geometrical change in the volume of the compression chambers 71*a* and 71*b* as the orbiting spiral body 1*b* and the fixed spiral body 2*b* relatively rotate. The main refrigerant increased in pressure to a high level pushes the discharge valve 11 open and is discharged into the discharge muffler 12. The main refrigerant is then discharged into the third space 74 and discharged as high-pressure refrigerant through the discharge pipe 102 to the outside of the scroll compressor 30.

(Flow of Injection Refrigerant)

The injection refrigerant, which is part of the main refrigerant discharged from the scroll compressor 30 and passed through the condenser 31, flows into the injection circuit 34, passes through the expansion valve 34*a*, and flows into the injection pipe 201 in the scroll compressor 30. Liquid or two-phase injection refrigerant flowing into the injection pipe 201 is divided by pipes (not shown) into two streams, which flow into the respective injection ports 202*a* and 202*b*. The refrigerant in the injection ports 202*a* and 202*b* either flows into the suction chambers 70*a* and 70*b* in the compression mechanism 8 as described above, or is blocked by the orbiting spiral body 1*b*.

In the technique disclosed in Patent Literature 1, when injection is performed for the purpose of lowering the discharge temperature, liquid refrigerant is injected through the injection port distant from the suction chamber. As a result, liquid refrigerant overflowing from the suction chamber flows down to the bottom of the hermetic container and refrigerating machine oil in the oil sump may be diluted.

On the other hand, in Embodiment 1, the outlets of the injection ports 202*a* and 202*b* are configured to directly open to the suction chambers 70*a* and 70*b*, and thus reducing the flow of injection refrigerant into the oil sump 100*a*. Consequently, it is possible in Embodiment 1 to inject a large amount of liquid or two-phase refrigerant and significantly reduce the discharge temperature.

In the technique disclosed in Patent Literature 2, the scroll compressor is configured such that the injection port always communicates with the compression chamber. In the technique disclosed in Patent Literature 3, the scroll compressor is configured such that the injection port communicates with the compression chamber in most rotation phases θ in one rotation. In these scroll compressors disclosed in Patent Literatures 2 and 3, the injection port has a dead volume that does not contribute to compressing refrigerant. Consequently, during operation that does not involve injection, unnecessary work is carried out when refrigerant accumulated in the dead volume is compressed, and thus degrading performance of the scroll compressor.

On the other hand, in Embodiment 1, the outlets of the injection ports 202*a* and 202*b* are configured to directly open to the suction chambers 70*a* and 70*b*. Consequently, the injection refrigerant is less likely to flow out into the oil sump 100*a* and it is possible to reduce dilution of the refrigerating machine oil stored in the oil sump 100*a*.

As the injection ports 202 open only to the suction chambers 70*a* and 70*b* and do not open to the compression chambers 71*a* and 71*b*, no dead volume is compressed in any rotation phase θ in one rotation. Consequently, loss of performance of the scroll compressor 30 can be reduced and the scroll compressor 30 of high efficiency can be obtained.

With the configuration described above, where the suction chambers 70*a* and 70*b* are provided with the injection ports 202*a* and 202*b*, respectively, a significant reduction in discharge temperature is achieved. However, even when only one of the suction chambers 70*a* and 70*b* is provided with an injection port, it is still possible to reduce the discharge temperature to some extent. That is, it is only necessary that the scroll compressor 30 have at least one injection port, such as that described above.

While refrigerant to be injected is liquid or two-phase refrigerant in the example described above, gas refrigerant having a temperature lower than suction refrigerant may be injected.

Embodiment 2

Embodiment 2 differs from Embodiment 1 in a manner in which the orbiting spiral body 1*b* of the orbiting scroll 1 and the fixed spiral body 2*b* of the fixed scroll 2 are combined together. Embodiment 2 describes only its features and omits the description of other characteristics.

Figure 10A:
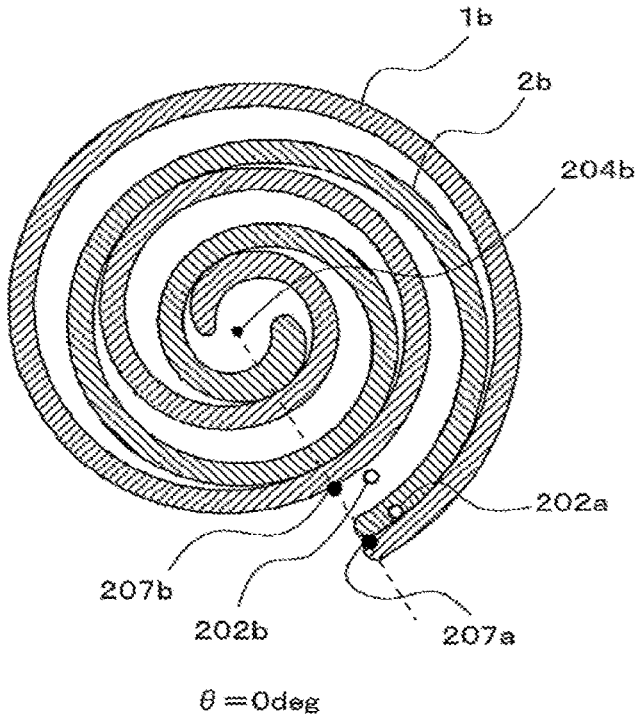
FIG. 10A is a compression process diagram illustrating an operation when a rotation phase θ is at 0 degrees in one rotation of the orbiting spiral body in a cross-section of a scroll compressor according to Embodiment 2 of the present invention, taken along line A-A in FIG. 1.
Figure 10B:
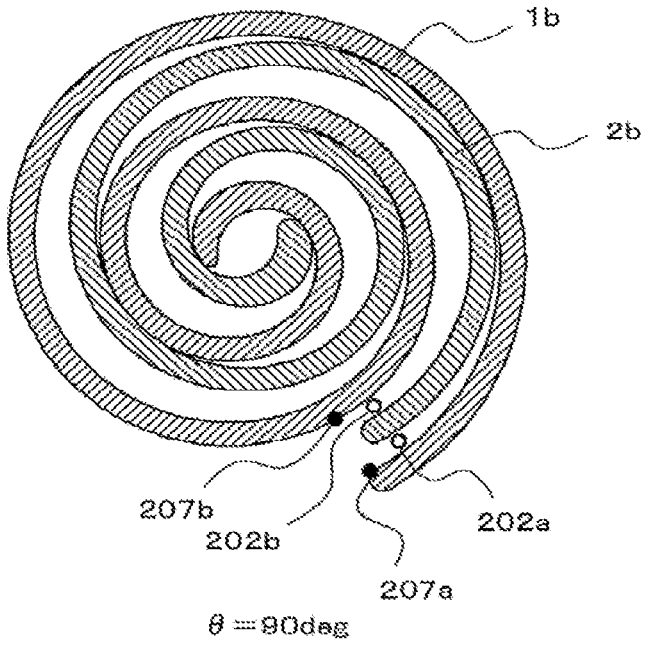
FIG. 10B is a compression process diagram illustrating an operation when the rotation phase θ is at 90 degrees in one rotation of the orbiting spiral body in the cross-section of the scroll compressor according to Embodiment 2 of the present invention, taken along line A-A in FIG. 1.
Figure 10C:
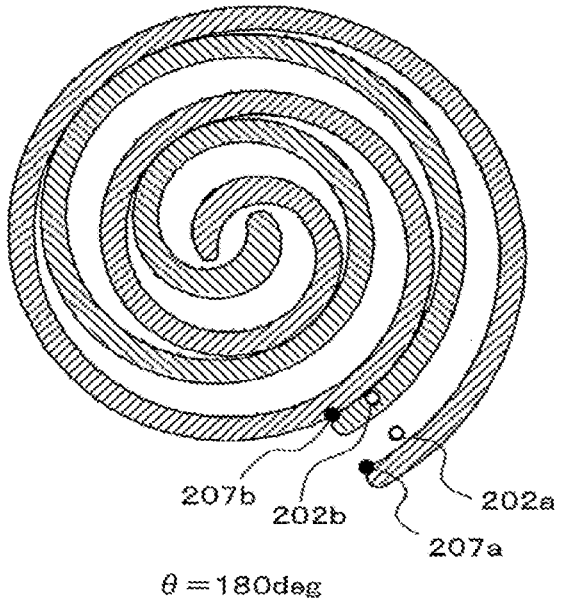
FIG. 10C is a compression process diagram illustrating an operation when the rotation phase θ is at 180 degrees in one rotation of the orbiting spiral body in the cross-section of the scroll compressor according to Embodiment 2 of the present invention, taken along line A-A in FIG. 1.
Figure 10D:
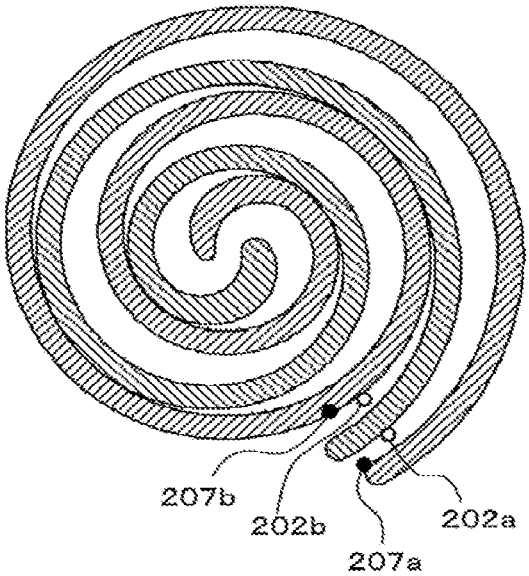
FIG. 10D is a compression process diagram illustrating an operation when the rotation phase θ is at 270 degrees in one rotation of the orbiting spiral body in the cross-section of the scroll compressor according to Embodiment 2 of the present invention, taken along line A-A in FIG. 1.

FIG. 10A is a compression process diagram illustrating an operation when a rotation phase θ is at 0 degrees in one rotation of the orbiting spiral body 1*b* in a cross-section of the scroll compressor 30 according to Embodiment 2 of the present invention, taken along line A-A in FIG. 1. FIG. 10B is a compression process diagram illustrating an operation when the rotation phase θ is at 90 degrees in one rotation of the orbiting spiral body 1*b* in the cross-section of the scroll compressor 30 according to Embodiment 2 of the present invention, taken along line A-A in FIG. 1. FIG. 100 is a compression process diagram illustrating an operation when the rotation phase θ is at 180 degrees in one rotation of the orbiting spiral body 1*b* in the cross-section of the scroll compressor 30 according to Embodiment 2 of the present invention, taken along line A-A in FIG. 1. FIG. 10D is a compression process diagram illustrating an operation when the rotation phase θ is at 270 degrees in one rotation of the orbiting spiral body 1*b* in the cross-section of the scroll compressor 30 according to Embodiment 2 of the present invention, taken along line A-A in FIG. 1.

FIGS. 10A to 10D illustrate how the orbiting spiral body 1*b* orbits as the rotation phase θ changes in order of 0 degrees, 90 degrees, 180 degrees, and 270 degrees.

In Embodiment 1, the orbiting spiral body 1*b* of the orbiting scroll 1 and the fixed spiral body 2*b* of the fixed scroll 2 are combined together in opposite phases. On the other hand, in Embodiment 2, the orbiting spiral body 1*b* of the orbiting scroll 1 and the fixed spiral body 2*b* of the fixed scroll 2 are combined together in the same phase. The winding-end contact points 207*a* and 207*b* are arranged in the same phase, not in opposite phases, around the base circle center 204*b* in such a manner that the compression mechanism 8 has an asymmetrical spiral shape.

In Embodiment 2, as in Embodiment 1, the injection ports 202*a* and 202*b* open only to the suction chambers 70*a* and 70*b* while the rotation phase θ changes in order of 0 degrees, 90 degrees, 180 degrees, and 270 degrees.

With the configuration described above, the following effects are achieved as well as those achieved in Embodiment 1.

That is, as in Embodiment 1, it is possible to completely prevent injection refrigerant from flowing into the compression chambers 71*a* and 71 *b* and to prevent the injection ports 202*a* and 202*b* from having a dead volume. It is also possible to reduce degradation of the reliability of the scroll compressor 30 associated with a decrease in the viscosity of refrigerating machine oil stored in the oil sump 100*a*.

In Embodiment 2, two injection ports 202*a* and 202*b* are located close to each other. As compared to Embodiment 1 where the injection ports 202*a* and 202*b* are distant from each other, the injection pipe 201 can be simplified, and the effect of injection can be achieved with a simpler structure.

While it is desirable that two injection ports be provided, the discharge temperature can be reduced to some extent even with only one injection port.

Embodiment 3

Embodiment 3 relates to the direction of opening of the injection port 202*a*. Embodiment 3 describes only its features and omits the description of other characteristics.

Figure 11A:
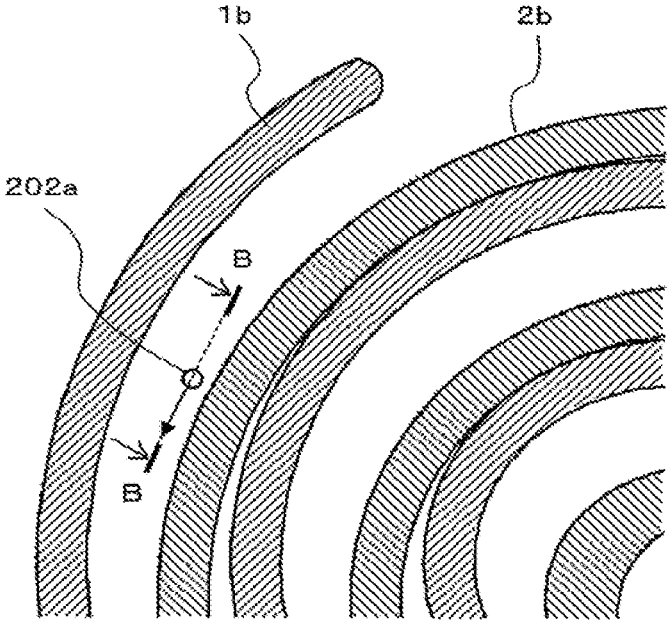
FIG. 11A is a diagram illustrating a main part of a scroll compressor according to Embodiment 3 of the present invention.
Figure 11B:
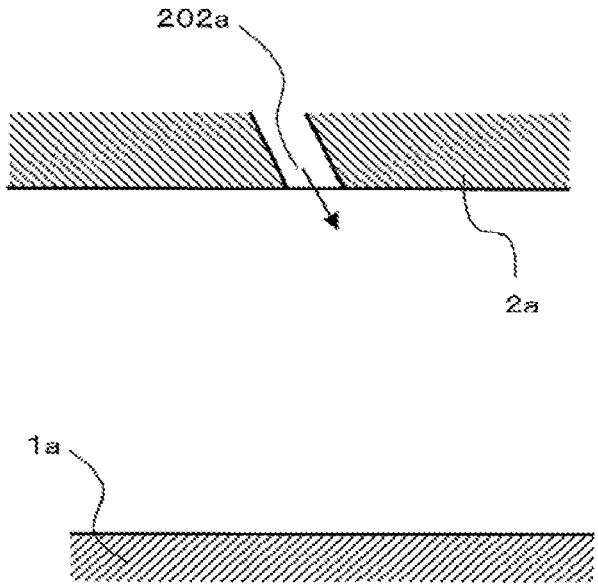
FIG. 11B is a cross-sectional view of the scroll compressor according to Embodiment 3 of the present invention, taken along line B-B in FIG. 11A.

FIG. 11A is a diagram illustrating a main part of the scroll compressor 30 according to Embodiment 3 of the present invention. FIG. 11B is a cross-sectional view of the scroll compressor 30 according to Embodiment 3 of the present invention, taken along line B-B in FIG. 11A.

In Embodiment 3, the fixed baseplate 2*a* is provided with the injection port 202*a* inclined to the axial direction of the rotation shaft 6. As the injection port 202*a* extends from its inlet to outlet, the injection port 202*a* is inclined inward in the spiral direction in which refrigerant is compressed along the spiral. Note that the injection port 202*b* has the same configuration as the injection port 202*a*.

With this configuration, the following effects are achieved as well as those achieved in Embodiment 1.

That is, injection refrigerant is ejected from the injection ports 202*a* and 202*b* toward the inside of the spiral opposite the suction ports 208*a* and 208*b*. This configuration reduces the flow of injection refrigerant from the suction ports 208*a* and 208*b* through the second space 73 to the first space 72, and further improves the reliability of the scroll compressor 30.

Embodiment 4

Embodiment 4 relates to the direction of opening of the injection ports 202. Embodiment 4 describes only its features and omits the description of other characteristics.

Figure 12A:
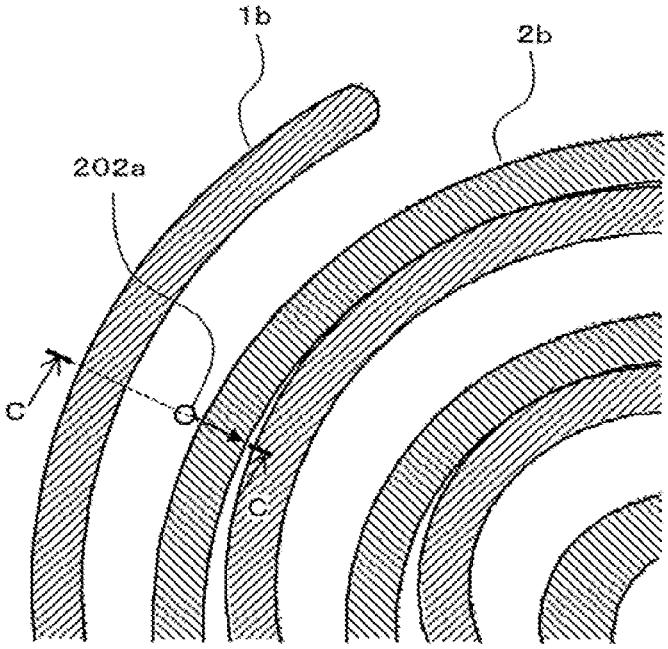
FIG. 12A is a diagram illustrating a main part of a scroll compressor according to Embodiment 4 of the present invention.
Figure 12B:
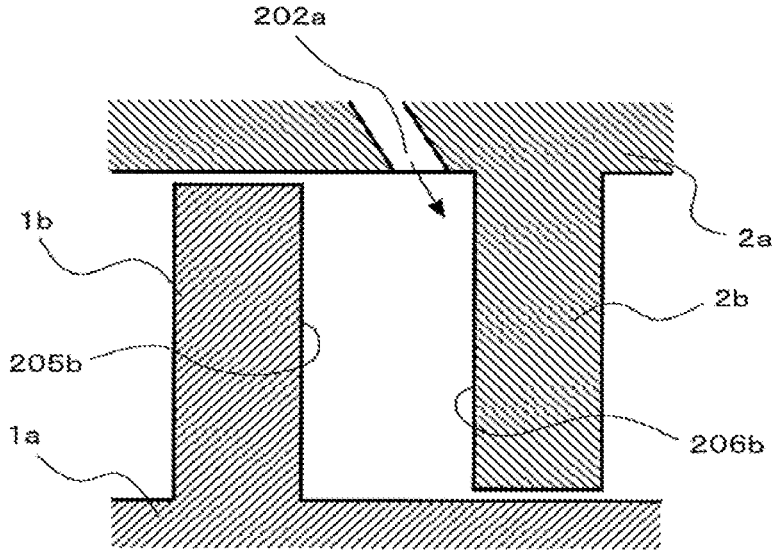
FIG. 12B is a cross-sectional view of the scroll compressor according to Embodiment 4 of the present invention, taken along line C-C in FIG. 12A.

FIG. 12A is a diagram illustrating a main part of the scroll compressor 30 according to Embodiment 4 of the present invention. FIG. 12B is a cross-sectional view of the scroll compressor 30 according to Embodiment 4 of the present invention, taken along line C-C in FIG. 12A.

In Embodiment 4, the injection port 202*a* is configured to open either toward the inward surface 205*a*, which is a wall surface of the orbiting spiral body 1*b* of the orbiting scroll 1, or toward the outward surface 206*b*, which is a wall surface of the fixed spiral body 2*b* of the fixed scroll 2. FIG. 12B illustrates an example in which the injection port 202*a* is directed toward the outward surface 206*b*, which is a wall surface of the fixed spiral body 2*b*, to allow ejection of injection refrigerant toward the fixed spiral body 2*b*. Note that the injection port 202*b* has the same configuration as the injection port 202*a*.

With this configuration, the following effects are achieved as well as those achieved in Embodiment 1.

That is, injection refrigerant ejected from the injection ports 202*a* and 202*b* collides with the inward surface 205*a* of the orbiting spiral body 1*b* of the orbiting scroll 1 or with the outward surface 206*b* of the fixed spiral body 2*b* of the fixed scroll 2, and is broken into small particles by impact of the collision. The injection refrigerant ejected from the injection ports 202*a* and 202*b* is thus broken into small particles in the compression mechanism 8. This configuration facilitates diffusion of the injection refrigerant, and promotes mixing with main refrigerant in the suction chambers 70*a* and 70*b*. Consequently, this configuration prevents refrigerating machine oil drawn into the suction chambers 70*a* and 70*b*, together with the main refrigerant, from being diluted by liquid refrigerant, and makes it possible to maintain sealing of the suction chambers 70*a* and 70*b* and the compression chambers 71*a* and 71*b*.

Embodiment 5

Embodiment 5 relates to the shape of longitudinal cross-section of the flow passage of each of the injection ports 202. Embodiment 5 describes only its features and omits the description of other characteristics.

Figure 13A:
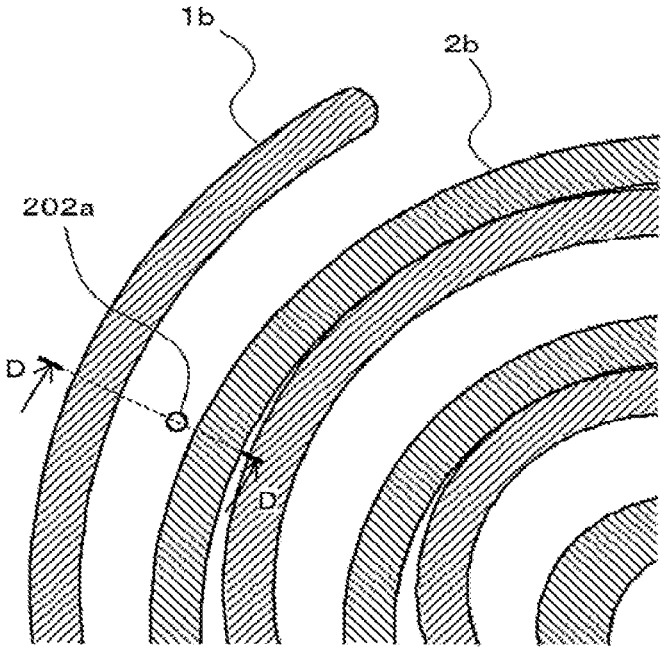
FIG. 13A is a diagram illustrating a main part of a scroll compressor according to Embodiment 5 of the present invention.
Figure 13B:
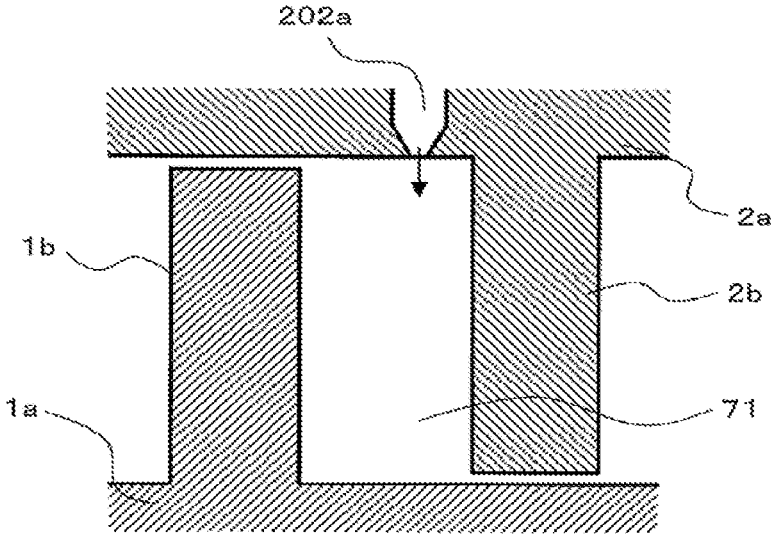
FIG. 13B is a cross-sectional view of the scroll compressor according to Embodiment 5 of the present invention, taken along line D-D in FIG. 13A.

FIG. 13A is a diagram illustrating a main part of the scroll compressor 30 according to Embodiment 5 of the present invention. FIG. 13B is a cross-sectional view of the scroll compressor 30 according to Embodiment 5 of the present invention, taken along line D-D in FIG. 13A.

In Embodiment 5, the injection port 202*a* is tapered in such a manner that the flow passage area decreases in the direction from the inlet toward the outlet of the injection port 202*a*, so that the refrigerant flow rate at the outlet of the injection port 202*a* increases. Note that the injection port 202*b* has the same configuration as the injection port 202*a*.

With this configuration, the following effects are achieved as well as those achieved in Embodiment 1.

That is, liquid or two-phase refrigerant broken into small particles is injected from the injection ports 202*a* and 202*b*, and broken into smaller particles by an increase in refrigerant flow rate. This configuration facilitates diffusion of the injected refrigerant, and promotes mixing with main refrigerant in the suction chambers 70*a* and 70*b*. Consequently, this configuration prevents refrigerating machine oil drawn into the suction chambers 70*a* and 70*b*, together with the main refrigerant, from being diluted by liquid refrigerant, and makes it possible to maintain sealing of the suction chambers 70*a* and 70*b* and the compression chambers 71*a* and 71*b*.

Embodiment 6

In Embodiment 6, a plurality of injection ports 202*a* are aligned along the direction in which the orbiting spiral body 1*b* extends. Embodiment 6 describes only its features and omits the description of other characteristics.

Figure 14A:
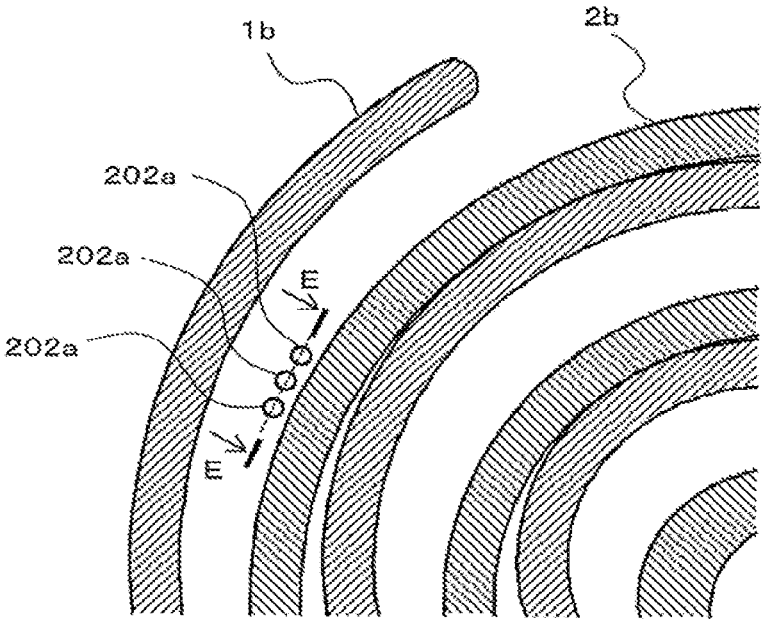
FIG. 14A is a diagram illustrating a main part of a scroll compressor according to Embodiment 6 of the present invention.
Figure 14B:
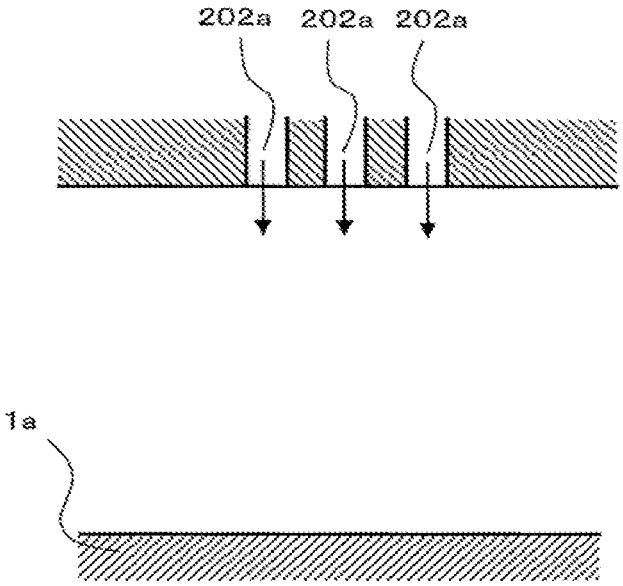
FIG. 14B is a cross-sectional view of the scroll compressor according to Embodiment 6 of the present invention, taken along line E-E in FIG. 14A.

FIG. 14A is a diagram illustrating a main part of the scroll compressor 30 according to Embodiment 6 of the present invention. FIG. 14B is a cross-sectional view of the scroll compressor 30 according to Embodiment 6 of the present invention, taken along line E-E in FIG. 14A.

In Embodiment 6, a plurality of injection ports 202*a* are aligned along the direction in which the orbiting spiral body 1*b* extends. FIG. 14 illustrate a configuration with three injection ports 202*a*. Note that the injection ports 202*b* are configured in the same manner as the injection ports 202*a*.

With this configuration, the following effects are achieved as well as those achieved in Embodiment 1.

That is, the injection ports 202*a* and 202*b* having a large area can be provided without allowing the injection ports 202*a* and 202*b* to pass across the orbiting spiral body 1*b* during orbiting. This configuration makes it possible to secure a flow passage area of injection refrigerant and obtain a necessary and sufficient amount of injection.

Embodiment 7

Embodiment 7 relates to the shape of transverse cross-section of the flow passage of each of the injection ports 202. Embodiment 7 describes only its features and omits the description of other characteristics.

Figure 15A:
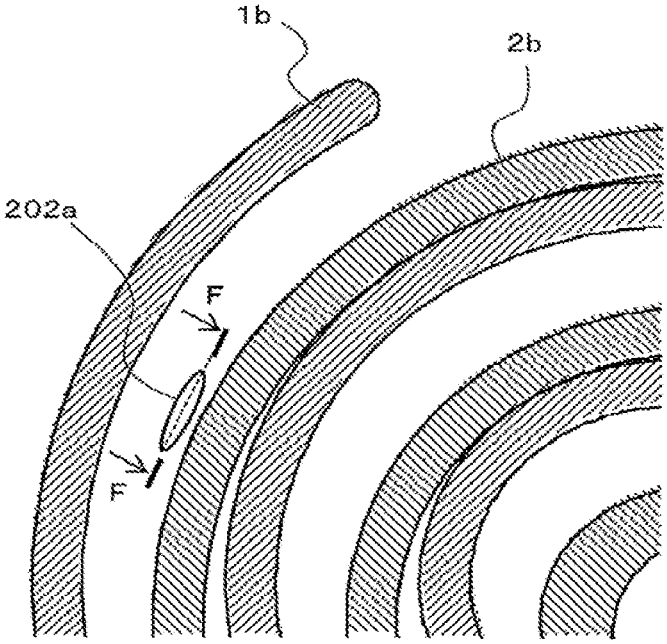
FIG. 15A is a diagram illustrating a main part of a scroll compressor according to Embodiment 7 of the present invention.
Figure 15B:
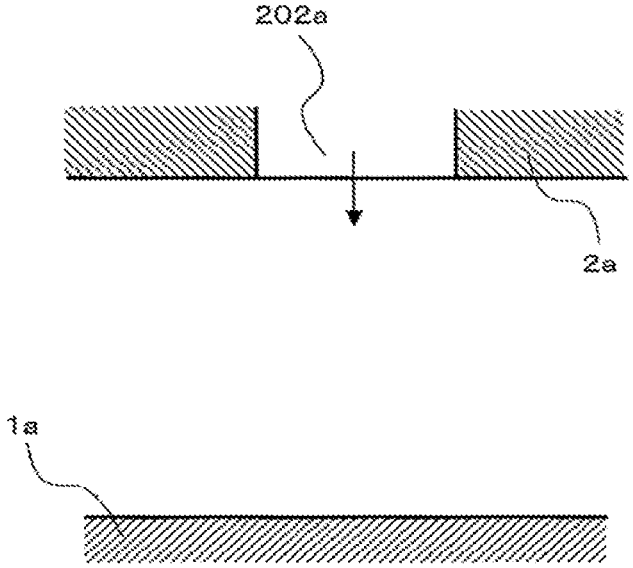
FIG. 15B is a cross-sectional view of the scroll compressor according to Embodiment 7 of the present invention, taken along line F-F in FIG. 15A.

FIG. 15A is a diagram illustrating a main part of the scroll compressor 30 according to Embodiment 7 of the present invention. FIG. 15B is a cross-sectional view of the scroll compressor 30 according to Embodiment 7 of the present invention, taken along line F-F in FIG. 15A.

In Embodiment 7, the transverse cross-section of the flow passage of the injection port 202*a* has a long flat shape along the direction in which the orbiting spiral body 1*b* extends. Note that the injection port 202*b* has the same configuration as the injection port 202*a*.

With this configuration, the same effects as those in Embodiment 1 are achieved. That is, the injection ports 202*a* and 202*b* having a large area can be provided without allowing the injection ports 202*a* and 202*b* to pass across the orbiting spiral body 1*b* during orbiting. This configuration makes it possible to secure a flow passage area of injection refrigerant and obtain a necessary and sufficient amount of injection.

While Embodiments 1 to 7 have been described as embodiments that are independent of each other, some characteristic configurations of Embodiments 1 to 8 may be appropriately combined to form the scroll compressor 30. For example, Embodiment 2 where the compression mechanism 8 has an asymmetrical spiral shape may be combined with Embodiment 5 that specifies the shape of longitudinal cross-section of the flow passage of each of the injection ports 202*a* and 202*b*, so that the shape of longitudinal cross-section of the flow passage of each of the injection ports 202*a* and 202*b* illustrated in FIGS. 10A to 10D is tapered as illustrated in FIG. 13B.

Embodiment 8

While refrigerant is injected in Embodiment 1, Embodiment 8 is configured to selectively inject refrigerant and refrigerating machine oil. Embodiment 8 describes only its features and omits the description of other characteristics.

Figure 16:
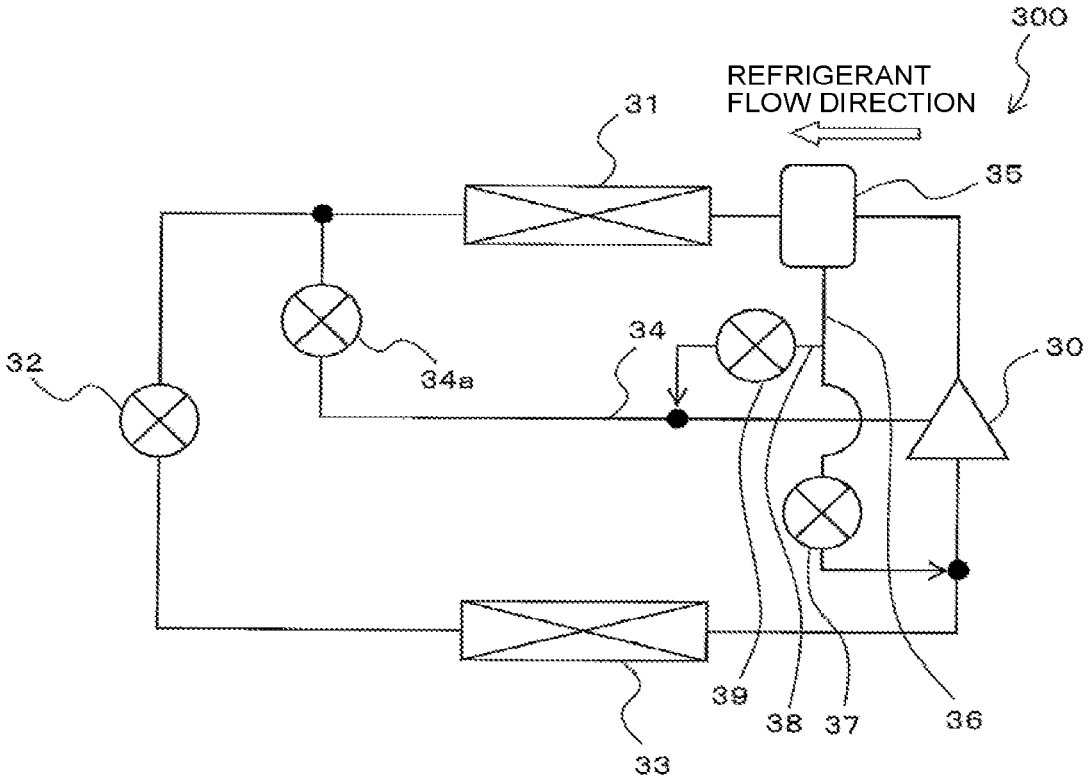
FIG. 16 illustrates an example configuration of a refrigeration cycle apparatus according to Embodiment 8 of the present invention.

FIG. 16 illustrates an example configuration of the refrigeration cycle apparatus 300 according to Embodiment 8 of the present invention.

In addition to the components illustrated in FIG. 9, the refrigeration cycle apparatus 300 according to Embodiment 8 includes an oil separator 35 disposed downstream of the scroll compressor 30 and configured to separate refrigerating machine oil from main refrigerant, and an oil injection circuit 36 configured to return the oil separated by the oil separator 35 to the scroll compressor 30.

The oil injection circuit 36 includes a control valve 37 serving as a first oil flow control valve that controls the flow rate, so that refrigerating machine oil to be returned to the scroll compressor 30 is controlled in amount and returned to the scroll compressor 30. The scroll compressor 30 according to any of Embodiments 1 to 7 may be used as the scroll compressor 30 in Embodiment 8.

Embodiment 8 further includes an oil injection pipe 38 having one end connected to the oil injection circuit 36 and the other end connected to the injection circuit 34, and a control valve 39 serving as a second oil flow control valve disposed in the oil injection pipe 38.

For example, the control valves 37 and 39 are each formed by an electronic expansion valve. The opening degree of the expansion valve 32, the opening degree of the expansion valve 34*a*, the opening degree of the control valve 37, the opening degree of the control valve 39, and the rotation frequency of the scroll compressor 30 are controlled by a controller (not shown).

In the configuration described above, when liquid refrigerant or two-phase refrigerant is injected from the injection circuit 34 to the injection ports 202 in the scroll compressor 30, the expansion valve 34*a* is opened and the control valves 37 and 39 are closed. When refrigerating machine oil is injected from the oil injection circuit 36 to the injection ports 202 in the scroll compressor 30, the control valve 39 is opened and the expansion valve 34*a* and the control valve 37 are closed. Thus, the refrigerating machine oil separated by the oil separator 35 passes through the oil injection pipe 38 and is injected from the injection ports 202 in the scroll compressor 30.

When refrigerating machine oil is returned from the oil injection circuit 36 toward the suction side of the scroll compressor 30, the control valve 37 is opened and the expansion valve 34*a* and the control valve 39 are closed. Thus, the refrigerating machine oil separated by the oil separator 35 is returned from the oil injection circuit 36 to the suction side of the scroll compressor 30.

As described above, Embodiment 8 allows selection of whether to inject either liquid (or two-phase) refrigerant or refrigerating machine oil, to the scroll compressor 30. Consequently, in a low-speed region that is more likely to be affected by tooth-tip leakage from the orbiting spiral body 1*b* of the orbiting scroll 1 and the fixed spiral body 2*b* of the fixed scroll 2, injecting the refrigerating machine oil from the injection ports 202 improves sealing of the compression chambers 71*a* and 71*b* formed by the orbiting spiral body 1*b* and the fixed spiral body 2*b*, and improves the performance of the scroll compressor 30.

Refrigerant and refrigerating machine oil may be injected from the injection ports 202 by opening both the expansion valve 34*a* and the control valve 39. This configuration improves sealing of a sliding portion during injection.

When refrigerating machine oil in the oil sump 100*a* runs short, both the control valve 37 and the control valve 39 may be opened to return refrigerating machine oil into the scroll compressor 30.

In a high-speed region, the discharge temperature can be lowered by injecting liquid or two-phase refrigerant.

In Embodiments 1 to 8, the scroll compressor 30 includes the hermetic container 100 into which refrigerant gas is drawn through the suction pipe 101. The scroll compressor 30 also includes the compression mechanism 8 disposed in the hermetic container 100, including the fixed scroll 2 and the orbiting scroll 1, and configured to compress refrigerant gas. The scroll compressor 30 also includes the motor mechanism 110 disposed in the hermetic container 100. The scroll compressor 30 also includes the rotation shaft 6 configured to transmit torque of the motor mechanism 110 to the orbiting scroll 1. The scroll compressor 30 also includes the injection ports 202 for introducing refrigerant flowing into the compression mechanism 8 through the injection pipe 201 that is different from the suction pipe 101. The fixed scroll 2 includes the fixed baseplate 2*a* and the fixed spiral body 2*b*, and the orbiting scroll 1 includes the orbiting baseplate 1*a* and the orbiting spiral body 1*b*. The compression mechanism 8 has the compression chambers 71*a* and 71 *b* and the suction chambers 70*a* and 70*b*. The compression chambers 71*a* and 71 *b* are closed between the fixed spiral body 2*b* and the orbiting spiral body 1*b*, and the suction chambers 70*a* and 70*b* are opened and into which the refrigerant gas in the hermetic container 100 is sucked. The injection ports 202 open only to the suction chambers 70*a* and 70*b* and are provided in the fixed baseplate 2*a* of the fixed scroll 2. In all phases of rotation of the rotation shaft 6, the injection ports 202 are located on an inner side of an outer edge of a structure unit that is configured by meshing the fixed spiral body 2*b* and the orbiting spiral body 1*b* of the compression mechanism 8 with each other.

With this configuration, injection refrigerant is less likely to flow out into the oil sump 100*a* and it is possible to reduce dilution of refrigerating machine oil stored in the oil sump 100*a*. It is also possible to inject a large amount of liquid or two-phase refrigerant and significantly reduce the discharge temperature.

As the injection ports 202 open only to the suction chambers 70*a* and 70*b* and do not open to the compression chambers 71*a* and 71*b*, no dead volume is compressed in any rotation phase θ in one rotation. Consequently, loss of performance of the scroll compressor 30 can be reduced and the scroll compressor 30 of high efficiency can be obtained.

The injection ports 202 are repeatedly closed and opened by the orbiting spiral body 1*b* of the orbiting scroll 1 as the orbiting scroll 1 orbits.

In this configuration, the injection ports 202 are repeatedly closed and opened as the orbiting scroll 1 orbits. This configuration reduces loss of performance of the scroll compressor 30 and makes it possible to provide the scroll compressor 30 of high efficiency.

The compression mechanism 8 is formed into an asymmetrical spiral shape by combining the fixed scroll 2 and the orbiting scroll 1 in the same phase around the center of rotation of the rotation shaft 6.

With this configuration, it is possible to completely prevent injection refrigerant from flowing into the compression chambers 71*a* and 71*b*, and to prevent the injection ports 202*a* and 202*b* from having a dead volume. It is also possible to reduce degradation of the reliability of the scroll compressor 30 associated with a decrease in the viscosity of refrigerating machine oil stored in the oil sump 100*a*.

As described above, the two injection ports 202*a* and 202*b* are located close to each other. Consequently, as compared to the case where the injection ports 202*a* and 202*b* are distant from each other, the injection pipe 201 can be simplified, and the effect of injection can be achieved with a simpler structure.

As the injection ports 202*a* and 202*b* each extend from its inlet to outlet, the injection ports 202*a* and 202*b* are each inclined toward the inside of the orbiting spiral body 1*b* and the fixed spiral body 2*b* in the spiral direction.

With this configuration, injection refrigerant is ejected from the injection ports 202*a* and 202*b* toward the inside of the spiral opposite the suction ports 208*a* and 208*b*. This configuration reduces the flow of injection refrigerant from the suction ports 208*a* and 208*b* through the second space 73 to the first space 72, and further improves the reliability of the scroll compressor 30.

As the injection ports 202*a* and 202*b* each extend from its inlet to outlet, the injection ports 202*a* and 202*b* each are inclined toward the outward surface 206*b* of the fixed spiral body 2*b* of the fixed scroll 2 or toward the inward surface 205*a* of the orbiting spiral body 1*b* of the orbiting scroll 1.

With this configuration, injection refrigerant ejected from the injection ports 202*a* and 202*b* collides with the inward surface 205*a* of the orbiting spiral body 1*b* of the orbiting scroll 1 or with the outward surface 206*b* of the fixed spiral body 2*b* of the fixed scroll 2, and is broken into small particles by impact of the collision. The injection refrigerant ejected from the injection ports 202*a* and 202*b* is thus broken into small particles in the compression mechanism 8. This configuration facilitates diffusion of the injection refrigerant, and promotes mixing with main refrigerant in the suction chambers 70*a* and 70*b*. Consequently, this configuration prevents refrigerating machine oil drawn into the suction chambers 70*a* and 70*b*, together with the main refrigerant, from being diluted by liquid refrigerant, and makes it possible to maintain sealing of the suction chambers 70*a* and 70*b* and the compression chambers 71*a* and 71*b*.

The injection ports 202*a* and 202*b* are tapered.

With this configuration, liquid or two-phase refrigerant broken into small particles is injected from the injection ports 202*a* and 202*b*, and broken into smaller particles by an increase in refrigerant flow rate. This configuration facilitates diffusion of the injected refrigerant, and promotes mixing with main refrigerant in the suction chambers 70*a* and 70*b*. Consequently, this configuration prevents refrigerating machine oil drawn into the suction chambers 70*a* and 70*b*, together with the main refrigerant, from being diluted by liquid refrigerant, and makes it possible to maintain sealing of the suction chambers 70*a* and 70*b* and the compression chambers 71*a* and 71*b*.

A plurality of injection ports 202*a* and a plurality of injection ports 202*b* are aligned along the direction in which the orbiting spiral body 1*b* extends.

With this configuration, the injection ports 202*a* and 202*b* having a large area can be provided without allowing the injection ports 202*a* and 202*b* to pass across the orbiting spiral body 1*b* during orbiting. This configuration makes it possible to secure a flow passage area of injection refrigerant and obtain a necessary and sufficient amount of injection.

A transverse cross-section of the flow passage of each of the injection ports 202*a* and 202*b* has a long flat shape along the direction in which the orbiting spiral body 1*b* extends.

With this configuration, the injection ports 202*a* and 202*b* having a large area can be provided without allowing the injection ports 202*a* and 202*b* to pass across the orbiting spiral body 1*b* during orbiting. This configuration makes it possible to secure a flow passage area of injection refrigerant and obtain a necessary and sufficient amount of injection.

The refrigeration cycle apparatus 300 includes the main circuit sequentially connecting the scroll compressor 30, the condenser 31, the expansion valve 32, and the evaporator 33, to allow refrigerant to circulate through the main circuit. The refrigeration cycle apparatus 300 also includes the injection circuit 34 branching off from a part between the condenser 31 and the expansion valve 32, and connected to the injection ports 202 in the scroll compressor 30. The refrigeration cycle apparatus 300 also includes the expansion valve 34*a* configured to control a flow rate in the injection circuit 34.

With this configuration, injection refrigerant, which is part of the main refrigerant discharged from the scroll compressor 30 and passed through the condenser 31, flows into the injection circuit 34, passes through the expansion valve 34*a*, and flows into the injection pipe 201 in the scroll compressor 30. Liquid or two-phase injection refrigerant flowing into the injection pipe 201 is divided by pipes (not shown) into two streams, which flow into the respective injection ports 202*a* and 202*b*. The refrigerant flowing into the injection ports 202*a* and 202*b* either flows into the suction chambers 70*a* and 70*b* in the compression mechanism 8 or is blocked by the orbiting spiral body 1*b*.

The refrigeration cycle apparatus 300 further includes the oil separator 35 disposed between the scroll compressor 30 and the condenser 31 of the main circuit. The refrigeration cycle apparatus 300 further includes the oil injection circuit 36 configured to cause refrigerating machine oil separated by the oil separator 35 to flow into the suction side of the scroll compressor 30. The refrigeration cycle apparatus 300 further includes the control valve 37 configured to control a flow rate in the oil injection circuit 36. The refrigeration cycle apparatus 300 further includes the oil injection pipe 38 having one end connected to the oil injection circuit 36 and the other end connected to the injection circuit 36. The refrigeration cycle apparatus 300 further includes the control valve 39 disposed in the oil injection pipe 38. Through control of the expansion valve 34*a*, the control valve 37, and the control valve 39, either one or both of the refrigerant and the refrigerating machine oil are selectively injected from the injection ports 202*a* and 202*b* into the suction chambers 70*a* and 70*b*.

With this configuration, in a low-speed region that is more likely to be affected by tooth-tip leakage from the orbiting spiral body 1*b* of the orbiting scroll 1 and the fixed spiral body 2*b* of the fixed scroll 2, injecting the refrigerating machine oil from the injection ports 202*a* and 202*b* improves sealing of the compression chambers 71*a* and 71 *b* formed by the orbiting spiral body 1*b* and the fixed spiral body 2*b*, and improves the performance of the scroll compressor 30.

The refrigerant and the refrigerating machine oil may be injected from the injection ports 202*a* and 202*b* by opening both the expansion valve 34*a* and the control valve 39. This configuration improves sealing of a sliding portion during injection.

When refrigerating machine oil in the oil sump 100*a* runs short, both the control valve 37 and the control valve 39 may be opened to return refrigerating machine oil into the scroll compressor 30.

In a high-speed region, the discharge temperature can be lowered by injecting liquid or two-phase refrigerant.

REFERENCE SIGNS LIST

1: orbiting scroll, la: orbiting baseplate, 1*b*: orbiting spiral body, 1*c*: orbiting bearing, 1*d*: boss, 2: fixed scroll, 2*a*: fixed baseplate, 2*b*: fixed spiral body, 2*c*: discharge port, 4: baffle, 5: slider, 6: rotation shaft, 6*a*: eccentric shaft portion, 6*b*: main shaft portion, 6*c*: sub-shaft portion, 7: frame, 7*a*: main bearing, 7*b*: boss, 7*c*: opening, 7*d*: opening, 8: compression mechanism, 9: sub-frame, 9*a*: sub-frame holder, 10: sub-bearing, 11: discharge valve, 12: discharge muffler, 13: sleeve, 30: scroll compressor, 31: condenser, 32: expansion valve, 33: evaporator, 34: injection circuit, 34*a*: expansion valve, 35: oil separator, 36: oil injection circuit, 37: control valve, 38: oil injection pipe, 39: control valve, 60: first balance weight, 61: second balance weight, 70*a*: suction chamber, 70*b*: suction chamber, 71*a*: compression chamber, 71*b*: compression chamber, 72: first space, 73: second space, 74: third space, 100: hermetic container, 100*a*: oil sump, 101: suction pipe, 102: discharge pipe, 110: motor mechanism, 110*a*: motor stator, 110*b*: motor rotor, 111: pump element, 201: injection pipe, 202: injection port, 202*a*: injection port, 202*b*: injection port, 204*a*: base circle center, 204*a*': base circle center, 204*b*: base circle center, 205*a*: inward surface, 205*b*: inward surface, 206*a*: outward surface, 206*b*: outward surface, 207*a*: winding-end contact point, 207*b*: winding-end contact point, 208*a*: suction port, 208*b*: suction port, 209*a*: contact point, 209*b*: contact point, 300: refrigeration cycle apparatus

The invention claimed is:

1. A scroll compressor, comprising:

a hermetic container into which refrigerant gas is drawn through a suction pipe;

a compression mechanism disposed in the hermetic container, including a fixed scroll and an orbiting scroll, and configured to compress the refrigerant gas;

a motor mechanism disposed in the hermetic container;

a rotation shaft configured to transmit torque of the motor mechanism to the orbiting scroll; and an injection port for introducing refrigerant flowing into the compression mechanism through an injection pipe that is different from the suction pipe, the fixed scroll and the orbiting scroll each including a baseplate and a spiral body, the compression mechanism having a compression chamber that is closed between the spiral body of the fixed scroll and the spiral body of the orbiting scroll, and a suction chamber that is unclosed and into which the refrigerant gas in the hermetic container is sucked, the injection port opening only to the suction chamber located between the spiral body of the fixed scroll and the spiral body of the orbiting scroll, the injection port being provided on the baseplate of the fixed scroll, and, in all phases of rotation of the rotation shaft, being located on an inner side of an outer edge of the compression mechanism that is configured by meshing the spiral body of the fixed scroll and the spiral body of the orbiting scroll with each other, the injection port is repeatedly opened to communicate with the suction chamber and closed to prevent communication with the suction chamber by the spiral body of the orbiting scroll as the orbiting scroll orbits.

2. The scroll compressor of claim 1, wherein the compression mechanism is formed into an asymmetrical spiral shape by combining the fixed scroll and the orbiting scroll in a same phase around a center of rotation of the rotation shaft.

3. The scroll compressor of claim 1, wherein, as the injection port extends from an inlet to an outlet of the injection port through the baseplate of the fixed scroll, the injection port is inclined toward an inside of the spiral bodies in a spiral direction.

4. The scroll compressor of claim 1, wherein, as the injection port extends from an inlet to an outlet of the injection port through the baseplate of the fixed scroll, the injection port is inclined toward a wall surface of the spiral body of the fixed scroll or toward a wall surface of the spiral body of the orbiting scroll.

5. The scroll compressor of claim 1, wherein the injection port is tapered so that a diameter of the injection port at one side of the baseplate of the fixed scroll is different than a diameter of the injection port at another side of the baseplate of the fixed scroll.

6. The scroll compressor of claim 1, wherein a plurality of the injection ports are aligned along a direction in which the spiral body extends.

7. The scroll compressor of claim 1, wherein a transverse cross-section of a flow passage of the injection port has a long flat shape along a direction in which the spiral body extends.

8. A refrigeration cycle apparatus, comprising:

a main circuit sequentially connecting the scroll compressor of claim 1, a condenser, a pressure reducing device, and an evaporator, to allow the refrigerant to circulate through the main circuit;

an injection circuit branching off from a part between the condenser and the pressure reducing device, and connected to the injection port in the scroll compressor; and a flow control valve configured to control a flow rate in the injection circuit.

9. The refrigeration cycle apparatus of claim 8, further comprising:

an oil separator disposed between the scroll compressor and the condenser of the main circuit;

an oil injection circuit configured to cause refrigerating machine oil separated by the oil separator to flow into a suction side of the scroll compressor;

a first oil flow control valve configured to control a flow rate in the oil injection circuit;

an oil injection pipe having one end connected to the oil injection circuit and another end connected to the injection circuit; and a second oil flow control valve disposed in the oil injection pipe, wherein, through control of the flow control valve, the first oil flow control valve, and the second oil flow control valve, either one or both of the refrigerant and the refrigerating machine oil are selectively injected from the injection port into the suction chamber.

* * * * *